US007603819B2

(12) United States Patent
Heltai

(10) Patent No.: US 7,603,819 B2
(45) Date of Patent: Oct. 20, 2009

(54) POCKET SHUTTER

(76) Inventor: Paul A. Heltai, 9756 Majorca Pl., Boca Raton, FL (US) 33434

( * ) Notice: Subject to any disclaimer, the term of this patent is extended or adjusted under 35 U.S.C. 154(b) by 0 days.

(21) Appl. No.: 11/836,246

(22) Filed: Aug. 9, 2007

(65) Prior Publication Data

US 2009/0038243 A1 Feb. 12, 2009

(51) Int. Cl.

| | |
|---|---|
| ***E06B 3/26*** | (2006.01) |
| ***E05C 7/02*** | (2006.01) |
| ***E05D 15/48*** | (2006.01) |
| ***E05F 11/52*** | (2006.01) |
| ***E05B 3/32*** | (2006.01) |

(52) U.S. Cl. ..... 52/202; 49/67; 49/163; 49/168; 49/463; 49/397; 160/117

(58) Field of Classification Search ..... 52/202, 52/203, 780, 781, 800.1, 800.13, 71, 222; 49/161, 162, 163, 168, 172, 174, 176, 177, 49/179, 182, 61, 62, 63, 67, 463, 464, 465, 49/466, 381, 397, 402, 103; 89/36.04; 160/117, 160/118, 119, 183, 210, 213

See application file for complete search history.

(56) References Cited

U.S. PATENT DOCUMENTS

| | | | | | |
|---|---|---|---|---|---|
| 252,873 | A * | 1/1882 | Freese | 49/62 |
| 284,117 | A * | 8/1883 | Byar | 160/91 |
| 722,533 | A * | 3/1903 | Nentwich | 49/159 |
| 1,005,344 | A * | 10/1911 | Soule | 19/153 |
| 1,632,333 | A * | 6/1927 | Healy | 49/246 |
| 1,889,159 | A * | 11/1932 | Stoddard | 160/117 |
| 2,208,166 | A * | 7/1940 | Sherron | 160/232 |
| 2,603,822 | A * | 7/1952 | Evans | 16/263 |
| 2,611,936 | A * | 9/1952 | Wheeler | 160/54 |
| 2,622,283 | A * | 12/1952 | Roos | 49/67 |
| 2,713,879 | A * | 7/1955 | Teague et al. | 160/117 |
| 2,753,205 | A * | 7/1956 | Forssell | 292/341.15 |
| 3,028,638 | A * | 4/1962 | Goellner | 52/800.14 |
| 3,269,455 | A * | 8/1966 | Gillotti | 160/369 |
| 3,297,077 | A * | 1/1967 | Garbus | 160/231.2 |
| 3,330,328 | A * | 7/1967 | Fagan | 160/88 |
| 3,351,973 | A * | 11/1967 | Lawrence, Jr. | 16/404 |
| 3,469,058 | A * | 9/1969 | Fontaine | 49/74.1 |
| 4,164,105 | A * | 8/1979 | Herbst et al. | 52/202 |
| 4,175,357 | A * | 11/1979 | Goldhaber | 49/395 |
| 4,462,186 | A * | 7/1984 | Fuller | 49/463 |
| 4,914,864 | A * | 4/1990 | Hohenfeld | 49/506 |
| 4,937,996 | A * | 7/1990 | Karlsson | 52/658 |
| 4,972,634 | A * | 11/1990 | Dresden | 52/69 |
| 5,603,190 | A * | 2/1997 | Sanford | 52/202 |
| 5,653,057 | A * | 8/1997 | Gary | 49/67 |

(Continued)

*Primary Examiner*—Robert J Canfield
*Assistant Examiner*—Brent W Herring
(74) *Attorney, Agent, or Firm*—Mayback & Hoffman, PA.; Gregory L. Mayback; Scott D. Smiley

(57) ABSTRACT

A shutter assembly includes a first and second shutter panel, where each panel includes a missile-repelling membrane panel, a frame having an elongated hollow body with inwardly disposed wall elements forming an inwardly facing U-shaped channel adapted to retain the membrane panel on at least two sides, and a membrane-retaining element separably attachable to the frame, allowing the membrane panel to be removed from the frame or secured within the frame.

12 Claims, 22 Drawing Sheets

U.S. PATENT DOCUMENTS 5,787,642 A * 8/1998 Coyle et al. ..... 49/61
5,848,505 A * 12/1998 Taylor ..... 52/202
5,852,903 A * 12/1998 Astrizky ..... 52/202
6,029,401 A * 2/2000 Gale ..... 49/465
6,363,670 B1 * 4/2002 Dewitt ..... 52/202
6,564,517 B1 * 5/2003 Hanssen ..... 52/204.51
6,591,553 B1 * 7/2003 Vaughn ..... 49/466
6,754,998 B2 * 6/2004 Diffrient et al. ..... 52/239
6,904,727 B2 * 6/2005 Edger ..... 52/215
6,996,934 B2 * 2/2006 Briscoe et al. ..... 49/67
7,040,056 B2 * 5/2006 DuBose et al. ..... 49/116
2004/0010988 A1 * 1/2004 Jaycox et al. ..... 52/202
2005/0210777 A1 * 9/2005 Baughn et al. ..... 52/202
2006/0101760 A1 * 5/2006 Cahoon ..... 52/459
2007/0107856 A1 * 5/2007 Cordova ..... 160/183
2008/0000175 A1 * 1/2008 Spoltore ..... 52/202
2008/0053010 A1 * 3/2008 Allen et al. ..... 52/202
2008/0086959 A1 * 4/2008 McNelis ..... 52/202

* cited by examiner

POCKET SHUTTER

CROSS-REFERENCE TO RELATED APPLICATION

This application claims the priority, under 35 U.S.C. § 119, of U.S. Provisional patent application Ser. No. 11/502,245, filed Aug. 10, 2006 and entitled Hurricane Pocket Shutter System, the entire disclosure of which is hereby incorporated herein by reference in its entirety.

FIELD OF THE INVENTION

This invention relates to shutters for protecting openings, and more particularly relates to a shutter assembly that protects building apertures from strong wind forces, wind-borne missiles, and other wind-related damage.

BACKGROUND OF THE INVENTION

Within hours of an announcement that a hurricane is coming to a specific geographical area, home and business owners scurry to add hurricane protection to their homes and business facilities. High winds cause flying debris to become air-borne projectiles capable of breaking glass windows and damaging property. Once a window is broken, the structural integrity of the entire building becomes problematic because of the pressure differences existing between the inside of the building and the environment. This pressure difference has the ability to cause roof loss, which is to be avoided. Thus hurricane protection is desirable.

Hurricane protection is currently available in many forms, which include permanent and temporary attachments to the structure that they are intended to protect. Examples of permanent construction additions include (a) accordion hurricane shutters, which are housed beside the windows when not in use and unfold to cover and protect during a storm. And, although they are easy for one person to make storm-ready, they are expensive to install and can detract from the aesthetics of the dwelling, need continuous maintenance, and, based on their roller mechanism, are prone to break more easily.

(b) colonial hurricane shutters, which are expensive louvered shutters that attach to the wall beside each window and fold together to protect the window. This type of shutter is easy for one person to make storm-ready, and actually can add to the beauty of the dwelling, however, depending on the construction, may require a time-consuming installation of a center bar and cannot be used to protect non-window openings such as doors.

(c) Bahama hurricane shutters, which are an expensive one-piece louvered shutter attached above the window and can be propped open to provide shade for the window. They are easily made storm-ready by one person when lowered and secured to the wall. Since the shutter is opaque, it creates a dark cave effect within the dwelling.

(d) roll-down hurricane shutters, which roll down from an enclosed box above the window and can easily be made storm-ready by one person. These shutters are the most expensive and can be relatively difficult to roll up after a storm during a power outage.

(e) hurricane glass, which, once installed, is, of course, the easiest to use since it becomes the window glass. However this specially treated glass (comprised of a synthetic layer sandwiched between glass) will break the outer layer upon impact. The center synthetic layer will prevent a hole, however, after the storm, the broken window or door and frame needs to be replaced at a significant cost.

(f) plastic screens, which are predominantly used to protect openings from high-speed wind, rain, and air-borne missiles. Although this type of shutter system theoretically can be installed initially by an installer and then by the home or business owner before each storm, installation is difficult and dependent on securely anchoring plastic screen holders and, furthermore, storm readiness depends on ability of home or business owner to secure studs into grommets, often taking more than one person to do so.

Examples of temporary additions include:

(a) corrugated storm panels, which are overlapped and mechanically fastened to a track of studs. Each panel is heavy and awkward to install (often requiring more than one person), takes a lot of time to install, and is opaque, making an enclosed dwelling dark and creates a cave-effect inside. Furthermore overlapping storm panels create a hazard if and when an emergency escape is required. These panels are virtually impossible to open from the inside.

(b) plywood storm panels, which are formed by one or more pieces of plywood and attached to the window or dwelling outside wall by means of anchors. Each panel is heavy and awkward and usually takes more than one person to install, takes a lot of time to install, does not allow light to pass through, and is not able to be opened from the inside.

(c) corrugated plastic panels, which are lightweight, translucent and relatively easy to install, however, the supporting structure is the weakest component of this type of hurricane shutter. Overlapping storm panels create a hazard if and when an emergency escape is required. These panels are virtually impossible to open from the inside.

Unfortunately, permanent construction additions typically require installation by a certified building contractor, which brings with it an associated skilled-labor cost. Temporary additions, on the other hand, are typically installed by homeowners and are therefore, less expensive. However, temporary additions require a large amount of time and labor on the part of the home or business owner to install the protection prior to a storm and to remove the protection after the storm.

Therefore, a need exists to overcome the problems with the prior art as discussed above.

SUMMARY OF THE INVENTION

A device is disclosed for protecting building apertures from damage during storms or other natural occurrences, such as hurricanes. In one embodiment, the invention comprises a shutter with a missile-repelling membrane panel surrounded by a frame with an elongated hollow body with inwardly disposed wall elements forming an inwardly facing U-shaped channel adapted to retain the membrane panel on at least two sides, and a membrane-retaining element separably attachable to the frame, allowing the membrane panel to be removed from the frame or secured within the frame.

In accordance with an embodiment of the present invention, the shutter includes a hinge attached to one side of the frame and providing a pivot for moving the shutter relative to a building structure.

In accordance with a further feature, an embodiment of the present invention includes a locking mechanism accessible from an interior of a building structure and preventing the shutter from significant movement relative to the building structure.

In accordance with a yet a further feature, an embodiment of the present invention includes a first, a second, and a third frame element, each element capable of receiving and retaining a separate side of the membrane panel.

In accordance with another feature, the membrane-retaining element includes an elongated hollow body with inwardly disposed wall elements forming an inwardly facing U-shaped channel adapted to retain the membrane panel on one side.

In accordance with the present invention, a shutter assembly includes a first and second shutter panel, each assembly having a missile-repelling membrane panel, a frame having an elongated hollow body with inwardly disposed wall elements forming an inwardly facing U-shaped channel adapted to retain the membrane panel on at least two sides, and a membrane-retaining element separably attachable to the frame, allowing the membrane panel to be removed from the frame or secured within the frame.

In accordance with a further feature, the present invention includes a first hinge with a first side attached to the frame of the first shutter panel and a second side attached to a building structure, and a second hinge with a first side attached to the frame of the second shutter panel and a second side attached to the building structure.

In accordance with a yet a further feature, the present invention includes a first stop attached to a lower portion of the frame of the first shutter panel, and a second stop attached to an upper portion of the frame of the second shutter panel, wherein the first stop and the second stop, when the lower portion of the frame of the first shutter is placed directly above the upper portion of the frame of the second shutter and a pivot of the first hinge is aligned with a pivot of the second hinge, allow the first and second shutters to be moved relative to each other in a first pivot direction and prevent the first and second shutters from moving relative to each other in a second pivot direction.

In accordance with an additional feature, the present invention includes an alignment track with a first portion that couples to the membrane-retaining element of the first shutter panel and a second portion that couples to the membrane-retaining element of the second shutter panel, the first and second portions of the alignment track making contact and preventing the first and second shutter panels from moving relative to each other in at least one direction.

In accordance with yet another feature, the first alignment track includes an F-shaped channel and the second alignment track includes an inverse-F-shaped channel.

In accordance with yet one more feature, the present invention includes a locking mechanism accessible from an interior of a building structure and preventing the shutter assembly from significant movement relative to the building structure.

In accordance with an additional feature, each membrane-retaining element includes an elongated hollow body with inwardly disposed wall elements forming an inwardly facing U-shaped channel adapted to retain the membrane panel on one side.

In accordance with a further feature, the present invention includes a set of ribs disposed within the hollow body of the frame and a set of ribs disposed inside the hollow body of the membrane-retaining element.

In accordance with an additional feature, the present invention includes an L-shaped bracket adapted to fit between the ribs in the frame and the ribs in the membrane retaining element and physically couple the frame and the membrane-retaining element.

BRIEF DESCRIPTION OF THE DRAWINGS

The accompanying figures, where like reference numerals refer to identical or functionally similar elements throughout the separate views, and which together with the detailed description below are incorporated in and form part of the specification, serve to further illustrate various embodiments and to explain various principles and advantages all in accordance with the present invention.

DETAILED DESCRIPTION

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

The present invention provides a novel and efficient shutter assembly that protects an aperture of a building during severe weather conditions, such as hurricanes, tornadoes, tsunamis, typhoons, and others. The assembly includes a hinged pocket system where one or more pockets have a rigid material to form a strong durable outer layer protecting a building's aperture, such as a windows or door, from wind and debris. A hinge system allows for easy installation and removal before or after storms and also allows one to open and re-close portions of the assembly for emergency escape.

Figure 1:
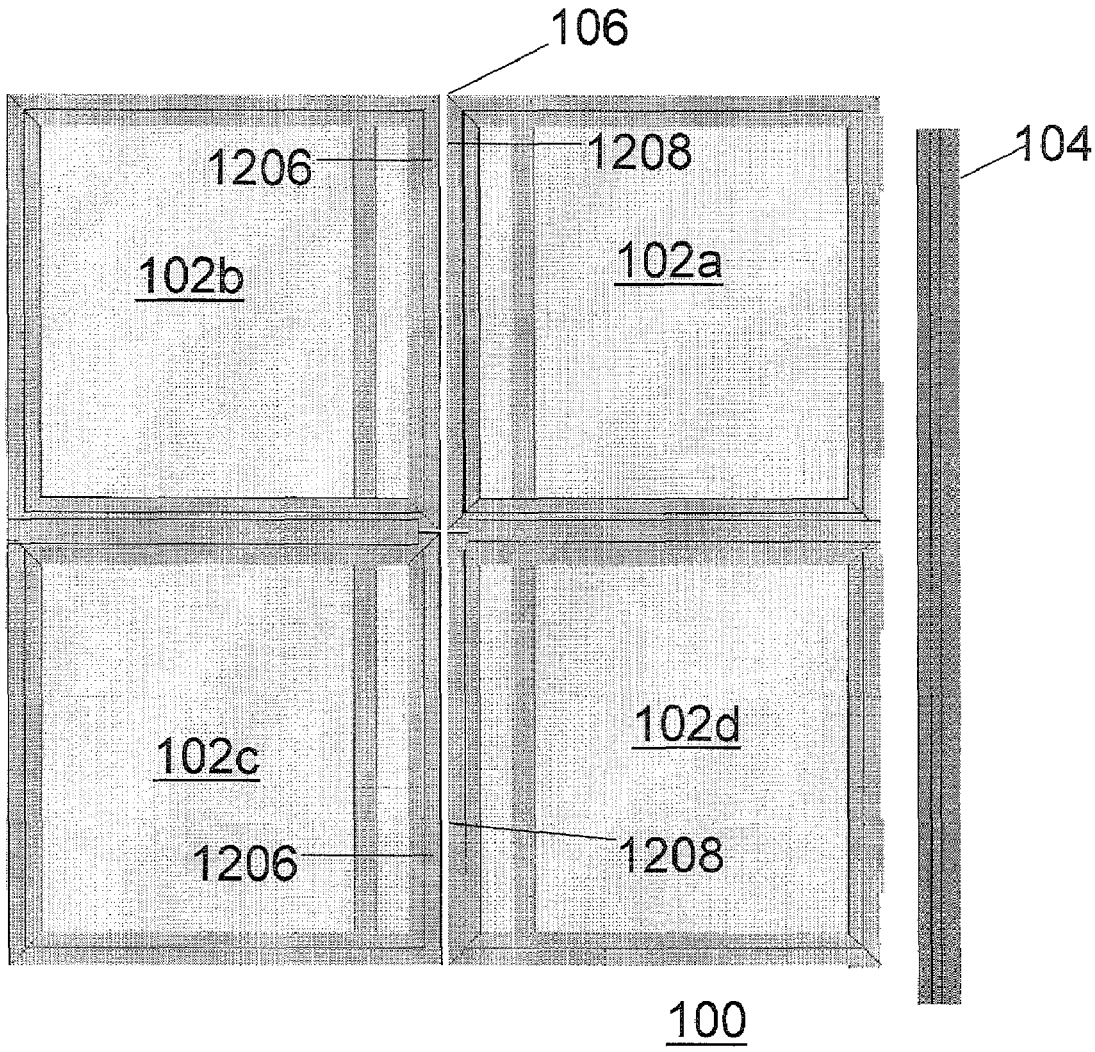
FIG. 1 is an elevational view of a shutter assembly, according to an embodiment of the present invention.

FIG. 1 shows an embodiment of a shutter assembly 100 in accordance with the present invention. The shutter assembly 100, as will be explained in detail below, interlocks with its associated parts to provide a solid protective surface that prevents projectiles from penetrating the assembly 100 and reaching the opening that the assembly 100 is protecting. The assembly 100 also prevents wind forces from exerting damaging pressure that often distorts and breaks unprotected windows or doors within the openings. As tested, the assembly 100 can withstand a 2×4 hitting the panel at 200 mph.

The assembly 100 shown in FIG. 1 includes four individual panels 102*a-d* that interlock with each other as will be shown in the subsequent figures and described below. An alignment channel 104, shown separated from the assembly 100 in this view, fits in the gap 106 between two panel sets, with one panel set being 102*b* and 102*c* and one panel set being 102*a* and 102*d*. The shape of the channel 104 and the interlocking relationship between the channel 104 and panels 102*a-d* will be explained in detail below and shown in FIG. 12.

Figure 2:
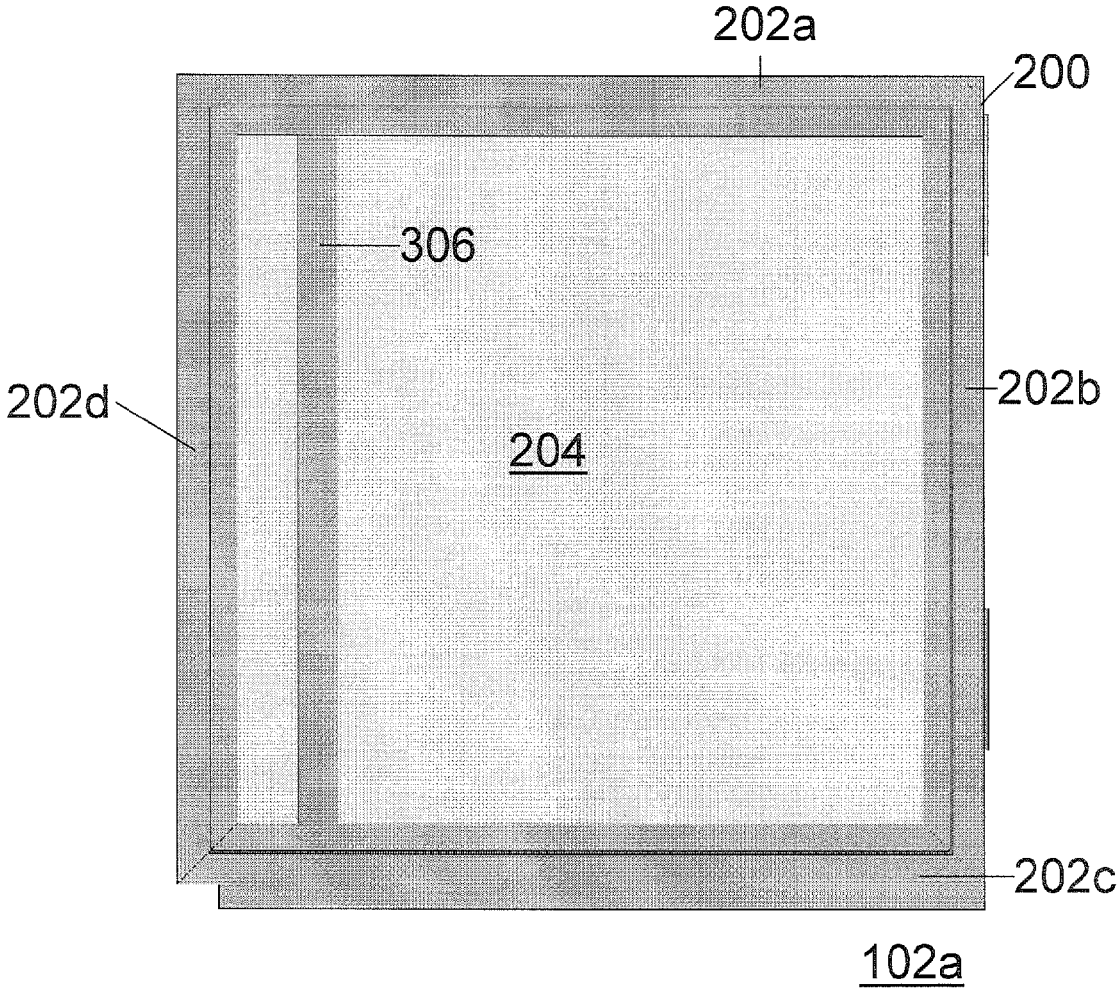
FIG. 2 is an elevational view of a shutter panel from the shutter assembly shown in FIG. 1.

Each panel 102*a-d*, in this embodiment, includes a protective missile-repelling membrane that is surrounded by and supported within a frame. Referring to FIG. 2, a front view of a single panel 102*a* is shown in an elevational view. The shutter panel 102*a* has a frame 200 that includes four main sections 202*a-d*. The four sections 202*a-d* fit together to form a rectangular shape that surrounds and supports a membrane panel 204. The frame 200 can be made of any sufficiently rigid material, such as aluminum or other metals, composites, wood, and others.

The membrane panel 204 includes a material that is able to withstand direct impacts from objects or wind pressure associated with severe weather conditions for which the panel 100 is intended to protect against. The membrane panel 204, in one embodiment, includes missile-repelling membrane material made of LEXAN. LEXAN is a registered trademark for General Electric's brand of highly durable polycarbonate resin thermoplastic intended to replace glass where the need for strength justifies its higher cost. LEXAN is similar to polymethyl methacrylate (Plexiglas/Lucite/Perspex)—commonly described as acrylic—in appearance, but is far more durable, often to the point of being described as "bulletproof" (depending on the thickness of the sample and the type of weapon used). LEXAN is advantageous because it is transparent and has great strength with a low weight.

Other suitable materials include KEVLAR Fiber, Carbon Fiber, Aluminum, Steel, Carbon Steel, Stainless Steel, Cooper, Brass, Reinforced Safety glass, Wood, Lumber, Plywood, Ceramic, Polycarbonate Sheet, Polycarbonate multi walls, Polycarbonate Corrugated Sheet, MAKROLON, MAKROLON multi walls, MAKROLON Corrugated Sheet, TUFFAK, TUFFAK multi walls, TUFFAK Corrugated Sheet, Plexiglas Sheet, multi walls and/or Corrugated, Polyethylene LDPE and HDPE, ABS, Acrylic sheets, Acrylic multi walls, Nano Tech materials, MICARTA, Fiberglass, Acetal, Polyvinyl Chloride, ceramic, and other materials. The selected membrane material is referred to herein as "missile-repellant" because it is able to withstand at least the required impact forces in accordance with the Hurricane Test Laboratory requirements and the Miami and Texas Building Codes.

Figure 3:
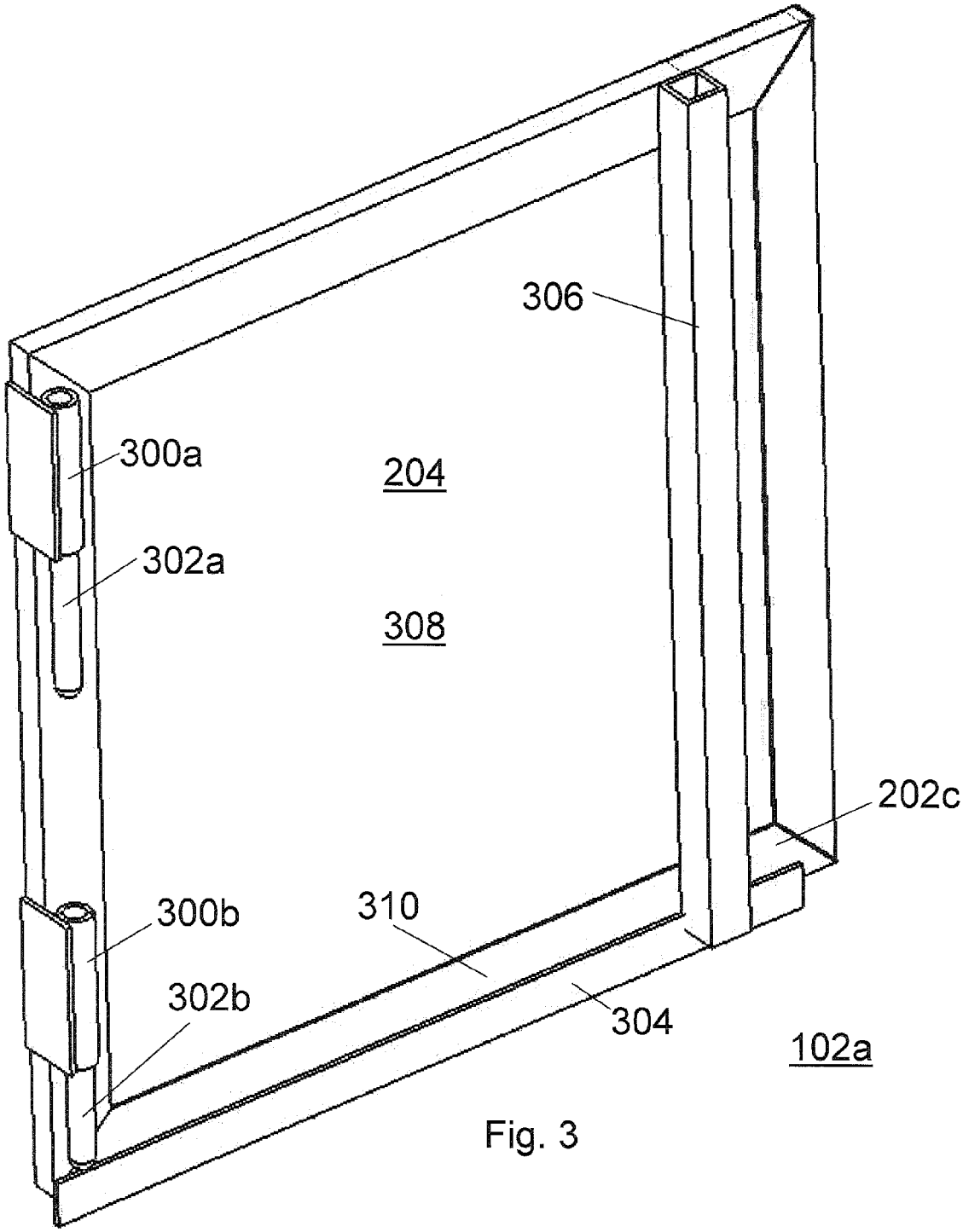
FIG. 3 is a perspective view of a back side of the shutter panel of FIG. 2.

Referring now to FIG. 3, a perspective view of a backside of the panel 102*a* is shown. From this back view, additional features of the present invention can be seen. First, the panel 102*a* includes a set of hinge portions 300*a* and 300*b*, which, in this embodiment is two, but can be more than two. The hinges portions 300*a* and 300*b* are male portions that mate with counterpart female hinge portions permanently attached to a wall. Although other attachment measures are acceptable, the hinges 300*a* and 300*b* are advantageous as they allow the panel 102*a* to be easily attached to a wall or other surface by sliding into their female hinge counterparts (see FIG. 6). In one embodiment, a pin portion 302*a* of one of the hinge portions 300*a* is longer than a pin portion 302*b* of the other hinge portion 300*b*. Having one pin portion 302*a* longer than the other pin portion 302*b* is advantageous as it simplifies installation. This is particularly true if there are more than two hinge portions on a single panel. Specifically, if all of the pin portions are the same length, an installer would have to align all male pin portions with all female receptacles simultaneously. This is often difficult if the panels are large and heavy or if they are being installed in hard-to-reach locations. With one pin being longer, the installer merely needs to focus on aligning the longest pin with its female counterpart. Once the longest pin mates with the female receptacle, the other pins will automatically become aligned and drop into position. In one embodiment, the uppermost pin is the longest pin.

Also shown in FIG. 3 is a support bar 306. Referring briefly back to FIG. 1, it can be seen that each of the panels 102*a-d* has a support bar near a center of the overall assembly 100. The support bars 306 add stability and strength to each panel 102*a-d* and to the overall assembly 100. During high winds, as occur during a hurricane, the weakest and most likely area of a window to break is its center. This is because the edges of the opening in the building provide adequate support to the corresponding edges of the window or other opening cover that are attached to the building. The center of the opening cover, however, has little or no support from the building. The support bars 306 of each panel 102*a-d* can be coupled to each other by any suitable measure to provide superior strength to the shutter assembly 100.

Figure 4:
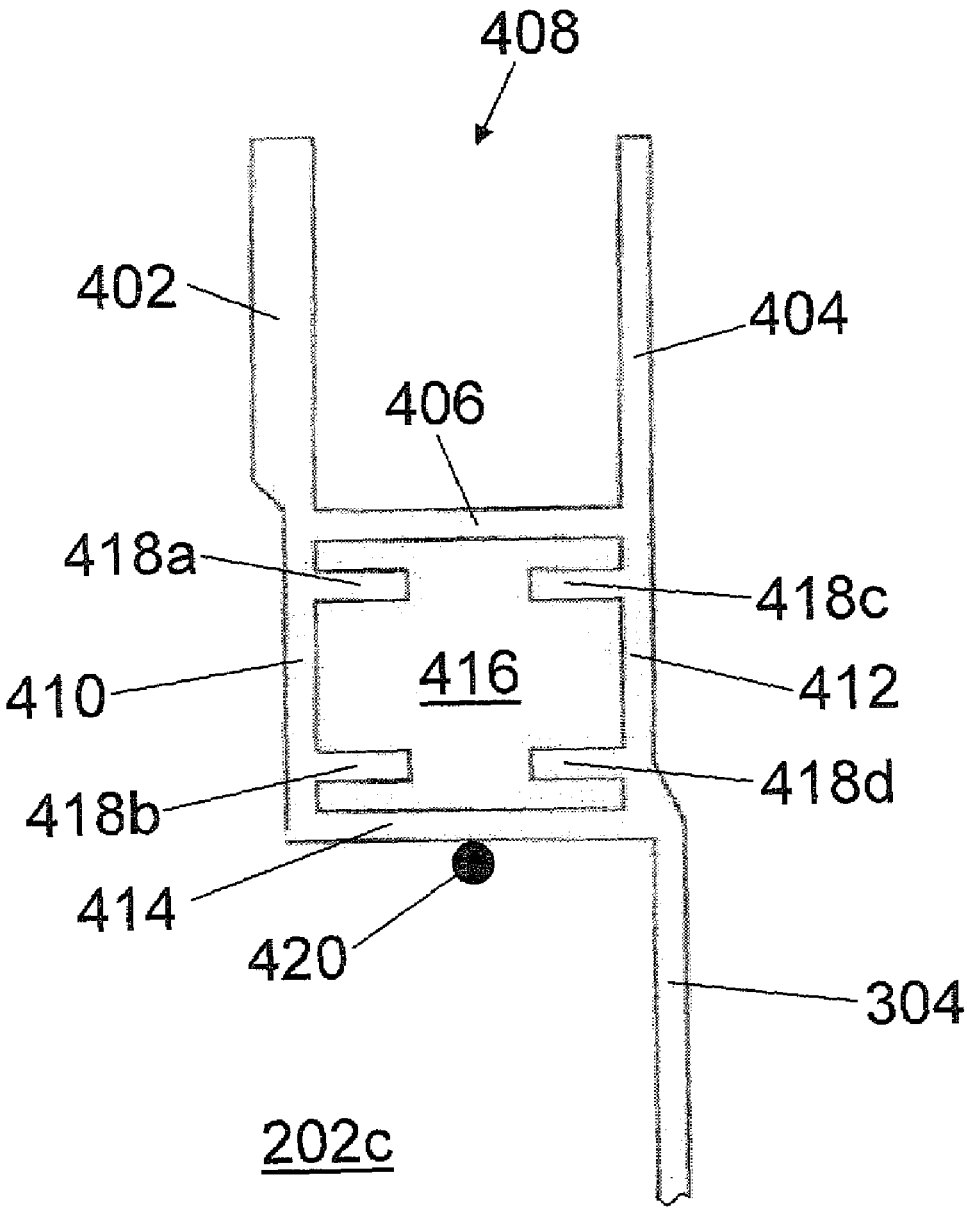
FIG. 4 is an edge view of one exemplary embodiment of a shutter panel frame element of the shutter panel of FIG. 2.

Returning again to FIG. 3, a stop 304 can be seen along a bottom edge 310 of the panel 102*a*. The stop 304 is attached to, or integral with the frame portion 202*c*, and extends below a bottom edge of the frame portion 202*c*. The stop 304 can run the entire length of the panel 102*a* or just a portion of the length. FIG. 4 shows an edge view of the lower frame portion 202*c*, where the stop 304 can be seen in more detail. The lower frame portion 202*c*, and each of the other frame portions 202*a*, 202*b*, and 202*d* are elongated hollow bodies having inwardly disposed wall elements 402, 406, and 404. The direction "inwardly" refers to a direction towards a central region of the membrane 204 and is shown as the mid-point 308 of the membrane in FIG. 3. Inwardly disposed wall elements 402, 406, and 404 form an inwardly facing U-shaped or C-shaped channel 408. The U-shaped channel 408 is useful for accepting and holding an edge portion of the membrane 204.

Element portion 202*c*, and each of the other frame portions 202*a*, 202*b*, and 202*d*, also include a first lower side wall element 410, a second lower side wall element 412 opposing the first lower side wall element 410, and a lower edge element 414 opposing the wall element 406. The element portion 202*c* is generally hollow as shown by cavity 416. Within this cavity 416 are a set of upstanding ribs 418*a-d*. Ribs 418*a* and 418*b* extend perpendicularly from wall element 410 and ribs 418*c* and 418*d* extend perpendicularly from wall element 412. The ribs 418*a-d* add rigidity and restrict the movement of the wall elements 410 and 412 to prevent bending or warping.

Extending from the second lower side wall element 412 on a side opposite the upper wall portion 404 is the stop 304. As will be shown in FIG. 5, the stop 304 ensures the proper alignment of the first panel 102*a* with the lower adjacent panel 102*d*. Additionally, attached to the lower edge element 414 is a spacer 420. The spacer 420, as will be shown in FIG. 5, reduces friction and self aligns the panel 102*a* when it mates with the panel 102*d*.

Figure 5:
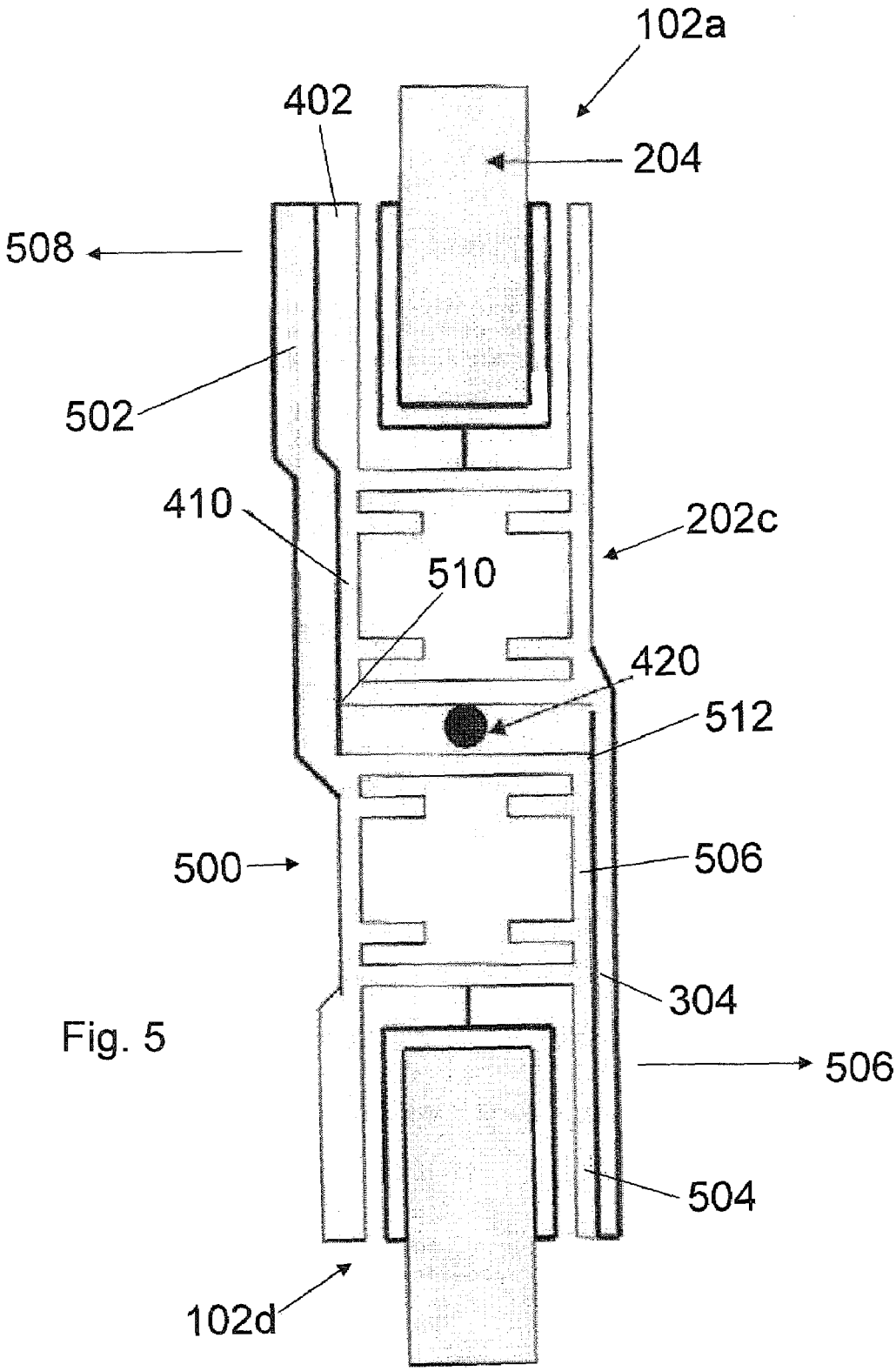
FIG. 5 is a cross-sectional view of one exemplary embodiment of a shutter panel frame element of the assembly of FIG. 1 aligned with another shutter panel frame element of the assembly of FIG. 1.

Referring now to FIG. 5, the first panel 102*a* is aligned with and directly on top of the lower panel 102*d*. This view reflects the configuration of FIG. 1. In this view, the lower frame portion 202*c* of the first panel 102*a* is shown mated with an upper frame portion 500 of the lower adjacent panel 102*d*. Each of the panels 102*a* and 102*d* has a stop 304 and 502, respectively, that automatically align the panels 102*a* and 102*d* with each other. The upper frame element 500 of the lower adjacent panel 102*d* has an upper stopper 502 that makes contact with the first upper wall element 402 and the first lower side wall element 410. Similarly, the stop 304 of the frame element 202*c* makes contact with a first lower wall element 504 and first upper side wall element 506 of the upper frame element 500 of the panel 102*d*. Once aligned in the position shown in FIG. 5, the stops 304 and 502 allow the upper panel 102*a* to separate from and move relative to panel 102*d* in a first direction 506, but prevent it from moving in a second direction 508.

The round spacer 420 provides a gentle ramp that allows the two panels 102*a* and 102*d* to close adjacent to each other. Without the spacer 420, a misalignment of the panels 102*a* and 102*d* could cause the corners 510 and 512, respectively, to hit each other and prevent the panels from closing. A similar spacer is located on the bottom of each of the lower panels 102*c* and 102*d* to provide easy closing within the opening of the building structure.

Figure 6:
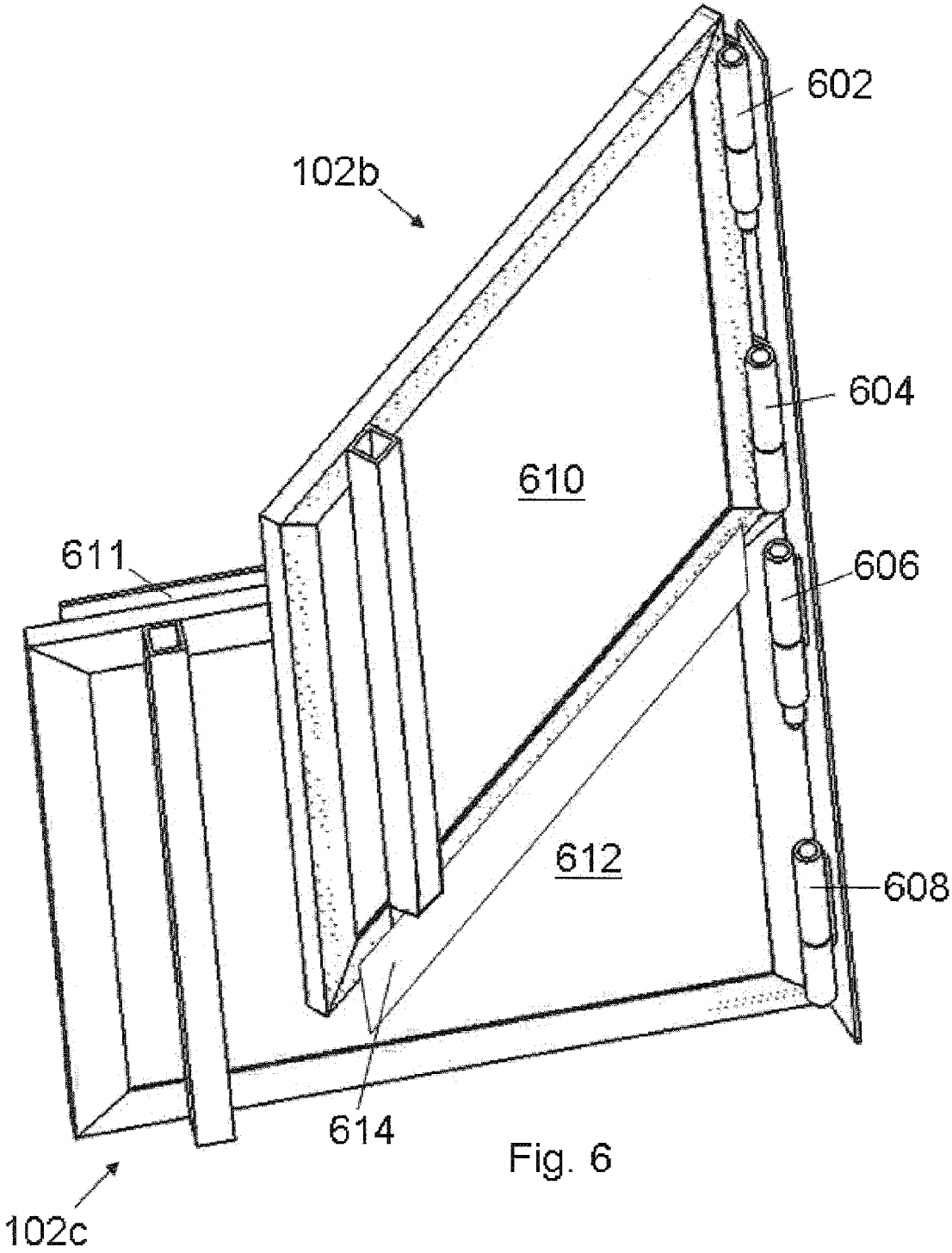
FIG. 6 is a perspective view of two vertically-adjacent shutter panels mounted upon a hinge assembly, according to an embodiment of the present invention.
Figure 7:
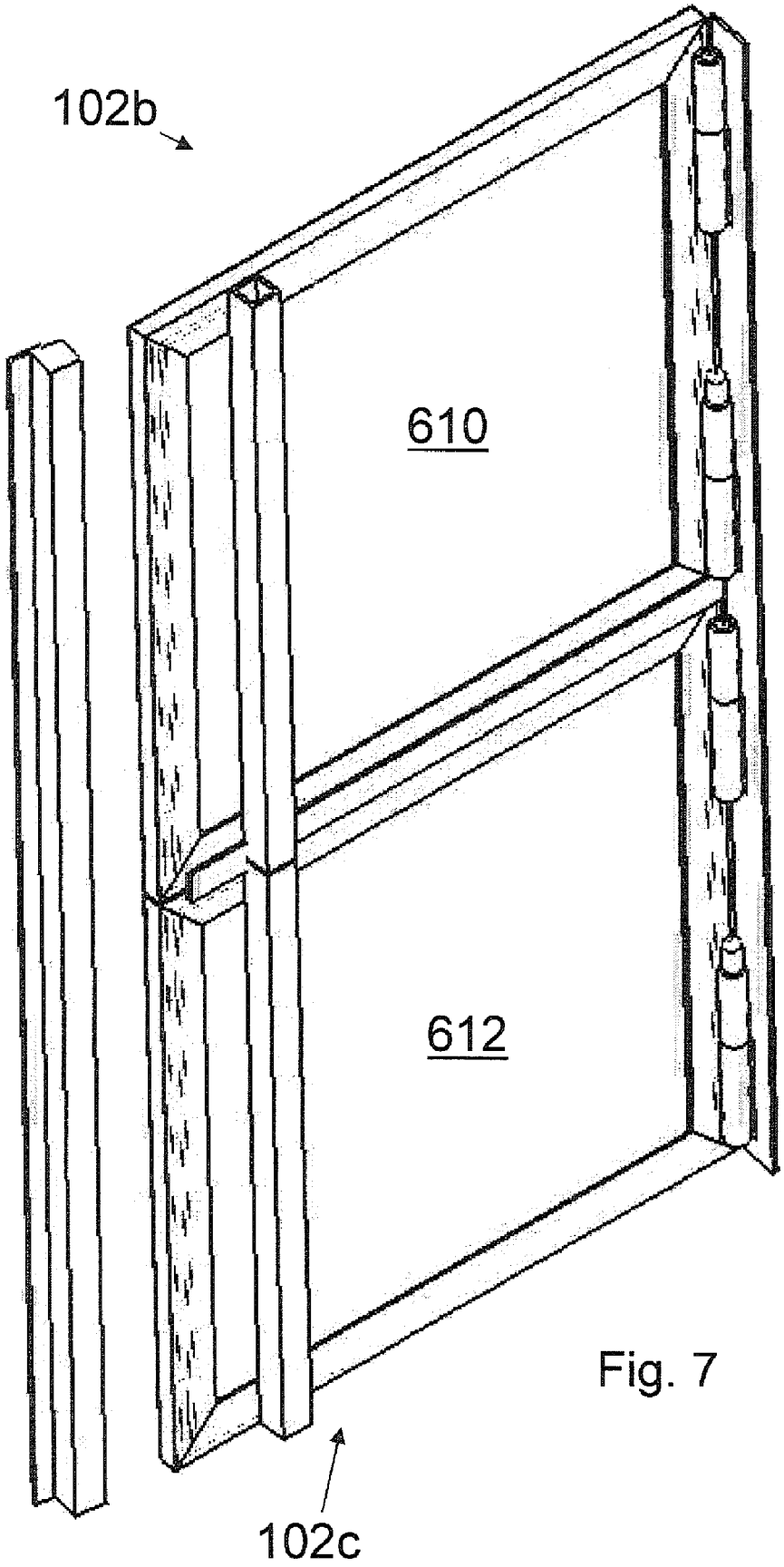
FIG. 7 is a perspective view of the shutter panels of FIG. 6 aligned in a co-planar configuration.

This relationship is shown in FIG. 6, where the upper panel 102*b* is not aligned with the lower panel 102*c*. By "not aligned," it is meant that the surfaces 610 and 612 of the membrane panels are not co-planar. The panels 102*b* and 102*c* are free to pivot along the hinges 602, 604, 606, and 608. This allows a user to install one panel at a time and then swing the panels toward each other to align them. This also allows a user to open the shutters to let air into the building or to escape from the building. A stop 611 attached to the lower panel 102*c* prevents the upper panel 102*b* from moving past a position, shown in FIG. 7, where the membranes 610 and 612 of the panels 102*b* and 102*c*, respectively, are co-planar with each other. Likewise, a stop 614, shown only in FIG. 6, on the upper panel 102*b* also prevents the upper panel 102*b* from moving past a position where the membranes 610 and 612 of the panels 102*b* and 102*c*, respectively, are, as shown in FIG. 7, co-planar with each other.

Figure 8:
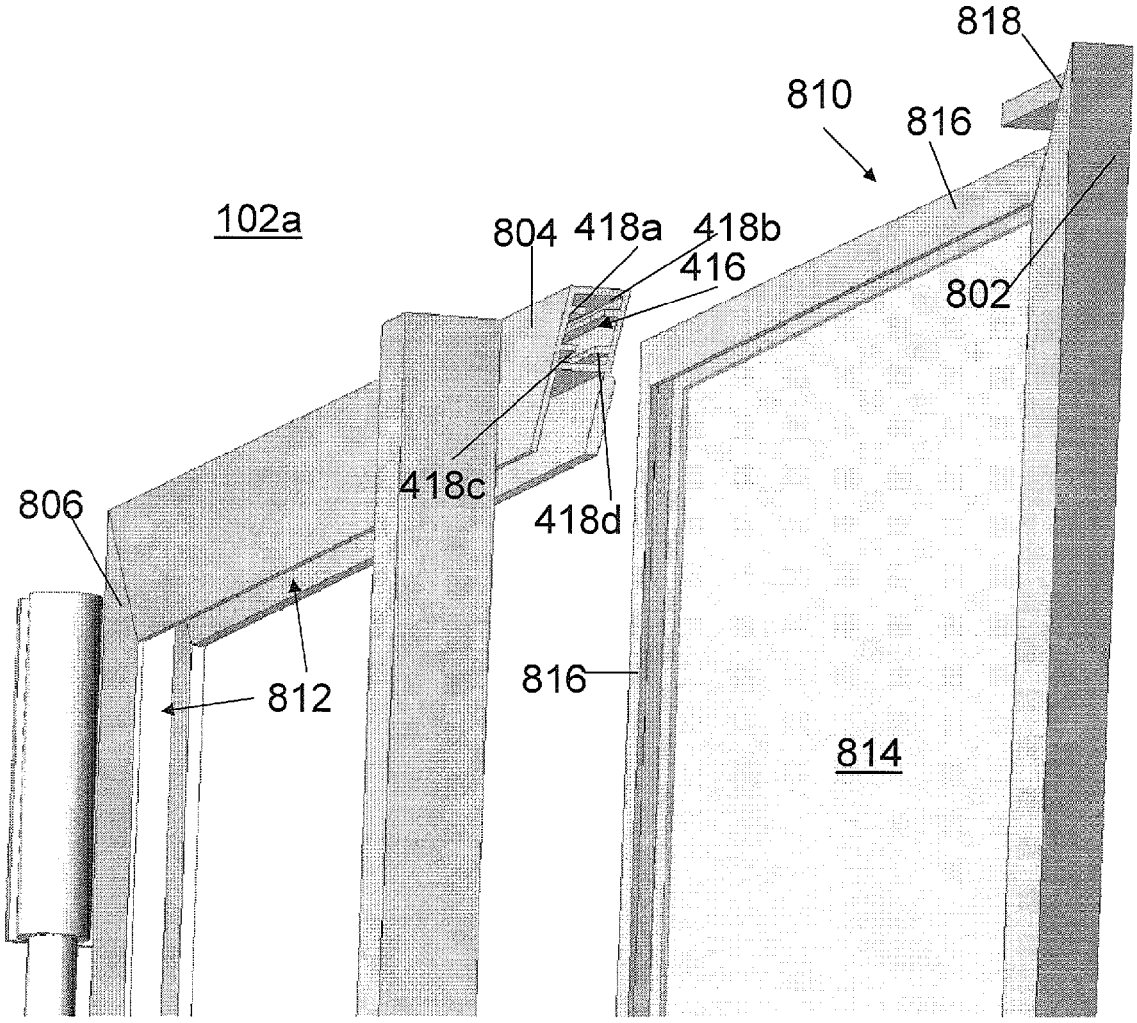
FIG. 8 is an enlarged perspective and partially exploded view of a membrane panel removed from the shutter panel frame of FIG. 2.

Referring now to FIG. 8, another inventive aspect of the present invention is shown. As can be seen in this view, one of the frame elements 802 is separable from the other three shutter panel frame elements 804, 806, and 808 (808 is not shown in this view.) By separating the first frame element 802 from the other three frame elements 804, 806, and 808, advantageously, the membrane panel 810 can be removed from the U-channel 812 created by the frame elements 804, 806, and 808. The membrane panel 810 can also be easily separated from the separable element 802. Removal of the membrane panel 810 from the shutter panel 102*a* provides several advantages. First, the shutter panels 102*a-d* are made considerably lighter by not having the weight of the membrane panel 810 in them. The reduced weight makes the shutter panels 102*a-d* easier to install, hang, take down, and transport. In addition, removing the membrane panel 810 and storing it in a controlled environment during the majority of the year, when storms are not a threat, extends the life and aesthetics of the protective membrane material. Also, the frames, without the membrane panel 810, can be left on the building structure without having a negative aesthetic effect on the building. Furthermore, if one of the membranes 814 should happen to crack, break, or otherwise need replacing, instead of having to replace the entire structure, as is done in prior-art storm protection systems, the single damaged membrane panel 810 can be removed and quickly replaced. This results in a drastic reduction in relevant cost to the user.

FIG. 8 shows that the membrane panel 810 includes a membrane material 814 surrounded by a frame 816. The frame 816 provides support and protection to the membrane material 814. Specifically, the frame 816 protects the edges of the membrane material 814 and provides durable surfaces that make contact with and couple to the U-channel 812 of the panel frame elements 802, 804, 806, and 808.

Figure 9:
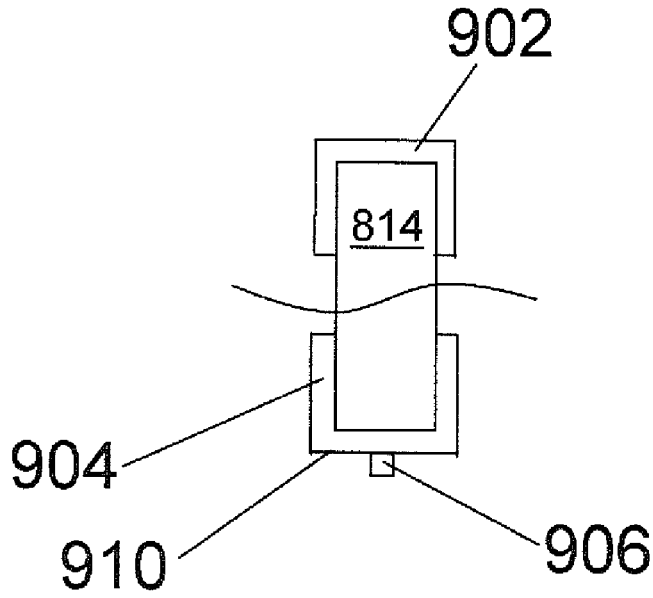
FIG. 9 is a fragmentary cross-sectional view of a membrane panel and frame, according to an embodiment of the present invention, with a first exemplary embodiment of a surface-resistance reducing ridge.

FIG. 9 shows a fragmentary cross-sectional view of the membrane material 814, upper element 902, and lower element 904 of the frame 816 affixed to the membrane material 814. In a first embodiment of the membrane frame 816, the lower membrane frame element 904 has an extension 906 protruding from a bottom surface 910 of the lower membrane frame element 904. The extension 906 is advantageous as it reduces the amount of surface area that makes contact with the lower element of the U-shaped channel 812 as the membrane frame 810 is slid into and out from the channel 812. Instead of the entire bottom surface 910 making contact, which could have a large friction, only the extension 906 touches the channel 812. By reducing the amount of surface area, the sliding resistance of the membrane frame 810 is reduced as it slides into the U-shaped channel 812. Because the membrane panels 810 are not limited in size, the panels 810 can be substantial in weight. This reduction in surface area can result in considerable reduction in installation effort.

Figure 10:
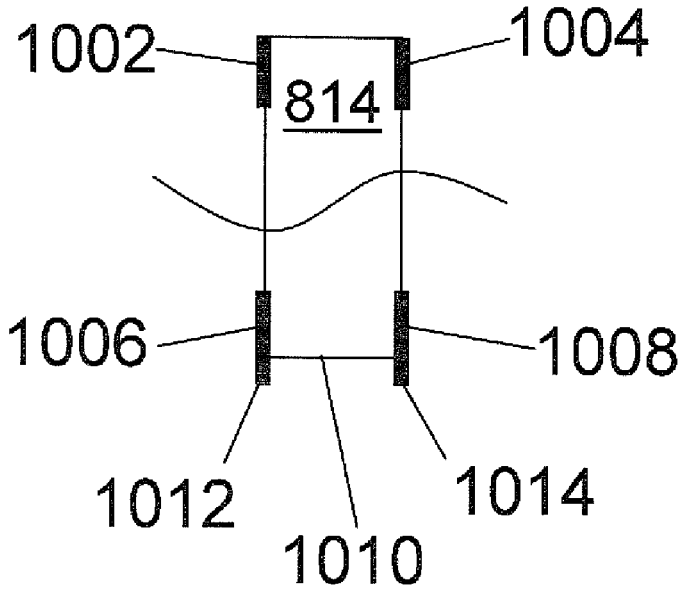
FIG. 10 is a fragmentary cross-sectional view of a membrane panel and frame, according to an embodiment of the present invention, with a second exemplary embodiment of surface-resistance reducing legs.

FIG. 10 shows another embodiment of the membrane frame 810. In this embodiment, the membrane material 814 has flat bars 1002, 1004, 1006, and 1008 attached at the top and bottom of the membrane material 814. The flat bars 1006 and 1008, attached at the bottom of the membrane material 814, extend beyond the bottom surface 1010 of the membrane material 814. When this embodiment of the membrane panel is slid into or out of the U-channel 812, only the bottom edges 1012 and 1014 of the flat bars 1006 and 1008 make contact with the lower element of the U-shaped channel 812. By reducing the amount of surface area, the sliding resistance of the membrane frame 810 is reduced as it slides into the U-shaped channel 812. In one embodiment, the flat bars 1002, 1004, 1006, and 1008 are attached to the membrane material 814 with adhesive, such as glue or double-sided tape. The bars 1002, 1004, 1006, and 1008 can be metal, plastic, or any other substantially rigid material.

Referring now back to FIG. 8, an alignment and coupling bracket 818 is shown at the top of the separable frame element 802. The bracket 818 is of a size to, when the frame is assembled, fit within the cavity 416 and, more particularly, between the set of internal ribs 418*a-d* of the upper frame element 804.

Figure 11:
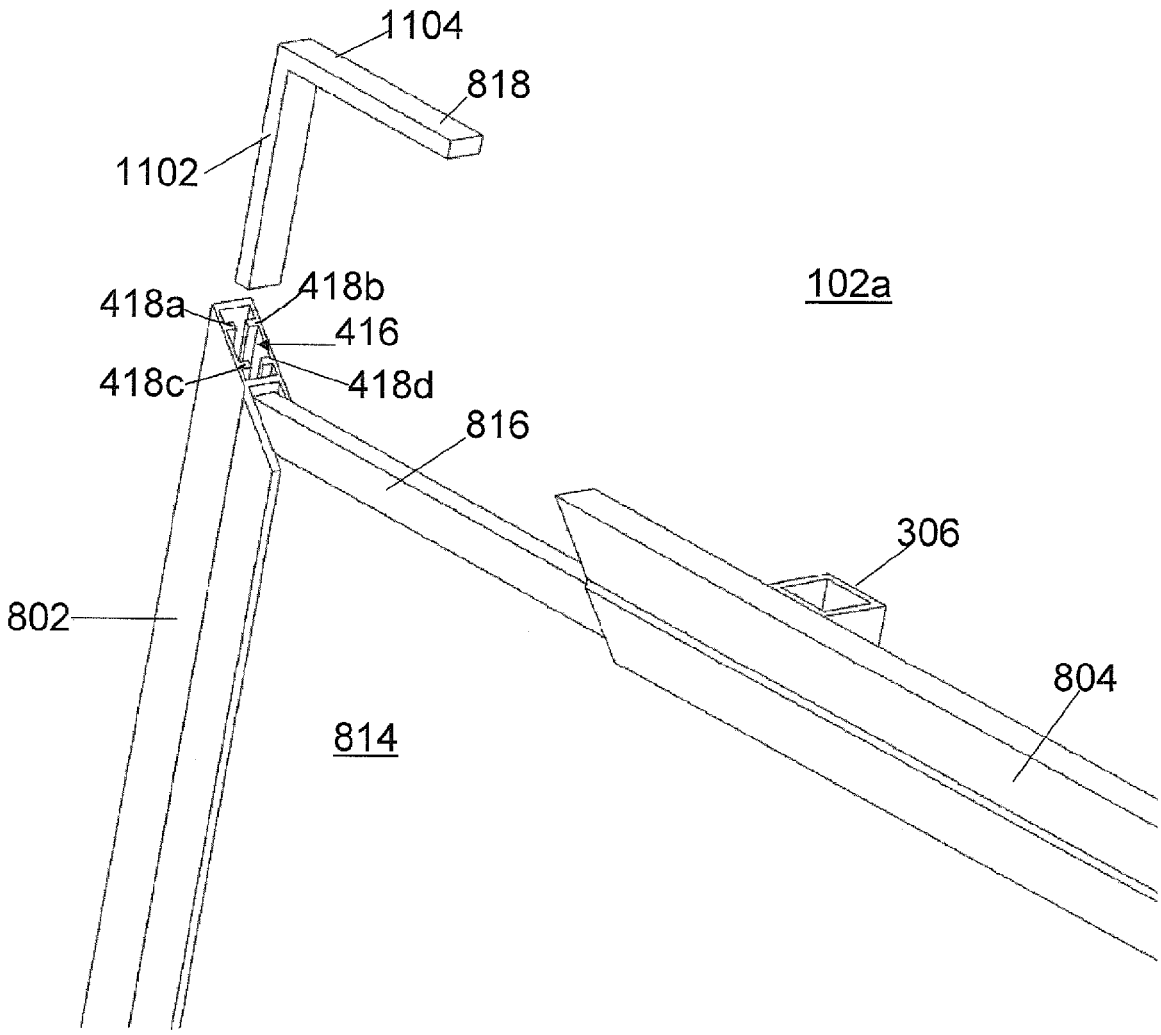
FIG. 11 is a fragmentary enlarged perspective and partially exploded view of a shutter panel frame alignment pin, according to an embodiment of the present invention.

FIG. 11 shows another view of the shutter panel 102*a*, where the bracket 818 is completely removed from both frame elements 802 and 804. Separable frame element 802 has the same internal rib structure as does frame element 804, which was shown in greater detail in FIG. 8. One half 1102 of the L-shaped bracket 818 slides into the cavity 416 in frame element 802 and the other half 1104, as shown in FIG. 8, slides into frame element 804. The L-shaped bracket 818 keeps the frame elements 802 and 804 at a consistent angle (approximately 90 degrees) and approximately co-planar with each other on both sides of the frame 200. Although not shown, a second L-shaped bracket fits in the opposing end of the frame element 802 and aligns the frame element 802 with a bottom element of the shutter frame 102*a*.

Figure 12:
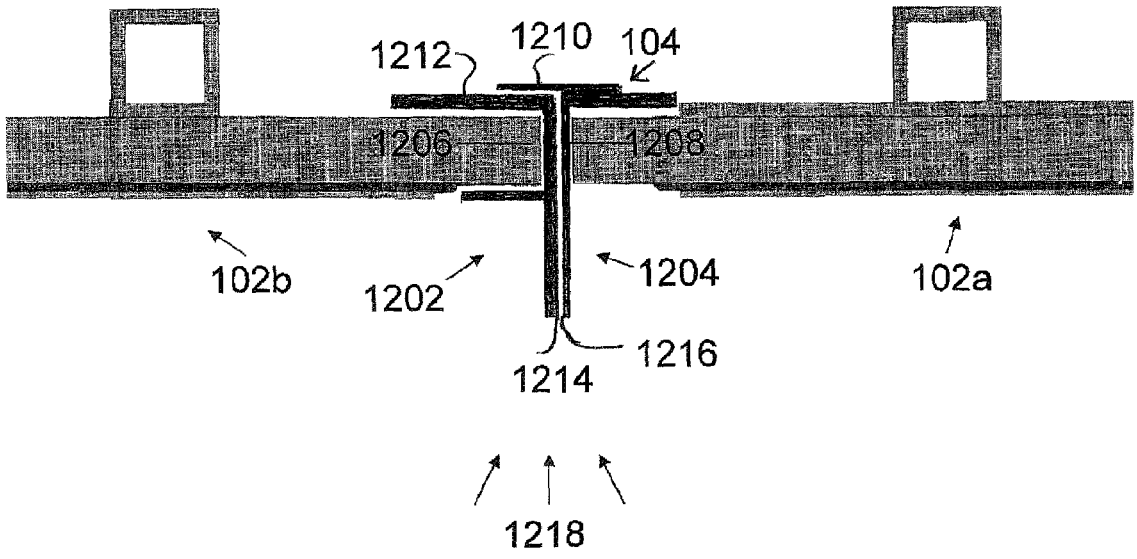
FIG. 12 is a fragmentary, enlarged plan view of an F-channel alignment track, according to an embodiment of the present invention.

FIG. 12 is an edge view of two adjacent panels 102*a* and 102*b*. Between the panels 102*a* and 102*b* is a pair of F-channel alignment tracks 1202 and 1204. The alignment tracks 1202 and 1204 are called "F" channel tracks because of their shape when looking along the edge, as shown in FIG. 12. One track, 1204, has the shape of an "F," and the other, 1202, has the shape of an reversed "F." The alignment tracks 1202 and 1204 attach to inside edges 1206 and 1208, respectively, of the shutter panels 102*b* and 102*a*, respectively. The alignment tracks 1202 and 1204 have at least two functions. First each track aligns vertically-adjacent panels. For instance, referring briefly back to FIG. 1, alignment track 1202 will attach to the inside edge 1206 of panels 102*b* and 102*c* and align them in a substantially co-planar configuration. Similarly, track 1204 will attach to an inside edge 1208 of panels 102*a* and 102*d* and align them in a substantially co-planar configuration.

Referring back now to FIG. 12, it can be seen that alignment track 1204 has a stop 1210 on one side. The stop 1210 makes contact with an outer surface 1212 of the other alignment track 1202 and, if panel 102*a* is held steady in the position shown in FIG. 12, prevents panel 102*b* from moving past a point where the two panels are co-planar. Additionally, the two alignment tracks 1202 and 1204 have opposing faces 1214 and 1216, respectively. The two opposing faces 1214 and 1216 butt against one another when force, such as strong wind 1218, is applied to the panels 102*a* and 102*b* and prevents the panels from moving relative to one another.

Figure 13:
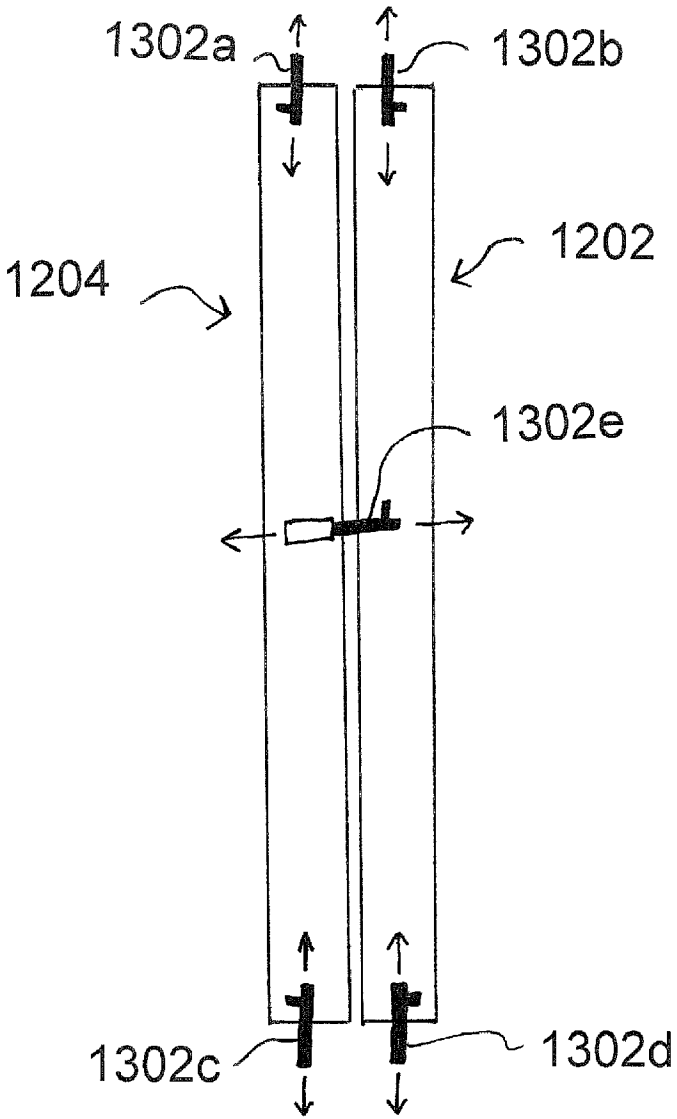
FIG. 13 is an elevational view of the F-channel alignment track of FIG. 13 with locking mechanisms, according to an embodiment of the present invention.

FIG. 13 shows an elevational view of one embodiment of the F-channel tracks 1202 and 1204, where locking mechanisms 1302*a-e* are coupled to the tracks 1202 and 1204. The particular locks shown in FIG. 13 are deadbolt locks, which are known in the art. However, other locking mechanisms can also be used. The locking mechanisms 1302*a* and 1302*b* physically couple the tracks 1202 and 1204, respectively, to an upper portion of a building structure. Similarly, the locking mechanisms 1302*c* and 1302*d* physically couple the tracks 1202 and 1204, respectively, to a lower portion of a building structure. The F-channel tracks 1202 and 1204, by coupling to a building structure, provide solid structural support to the overall shutter assembly 100. In addition, a locking mechanism 1302*e* physically couples the two tracks 1202 and 1204 to each other, thereby adding further strength to the overall shutter assembly 100 by preventing the first track 1202 from moving relative to the second track 1204. An advantage to the placement of the locking mechanisms 1302*a-e* is that they are reachable by one standing on the interior of the building. This allows one to unlock and open the shutter panels, for instance, to exit the building or to begin removal of the shutter assembly 100 from the building.

Embodiments or versions of shutters configured with the present invention may be divided into two major categories. A shutter within the first category is for a single pocket module used to protect a window or door opening sized less than or equal to 48-inches by 48-inches. A shutter within the second category is for multiple pocket modules used to protect a window or door opening sized larger than 48-inches by 48-inches.

Various versions or embodiments of the present invention will now be discussed in the general order described above. That is, a discussion of examples from the first category will be followed by a discussion of examples from the second category.

Figure 14:
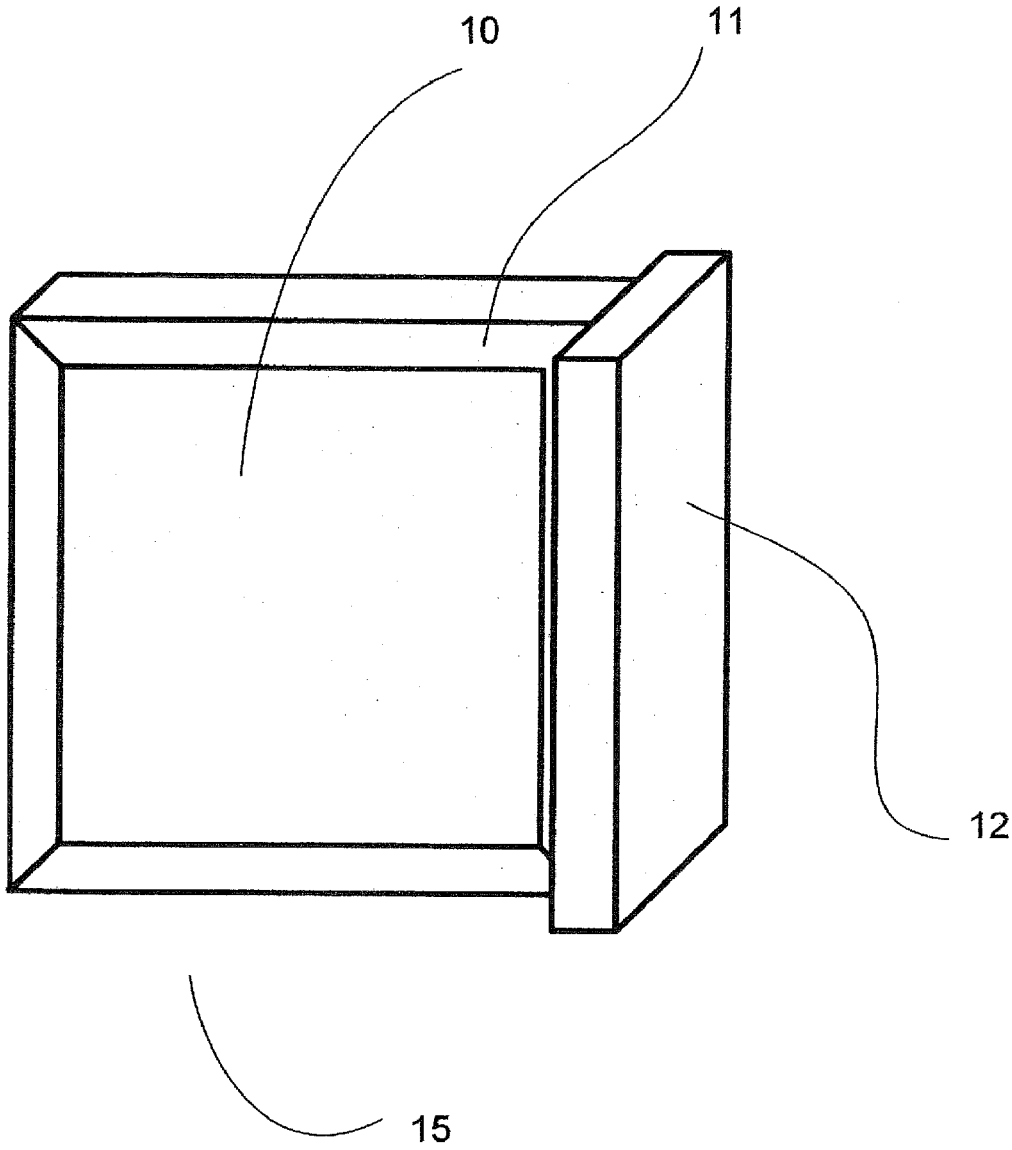
FIG. 14 is an isometric view of a plastic insert with outer flange, according to an embodiment of the present invention.

The hurricane pocket shutter system is comprised of one or more modules, where each module includes a pocket like frame and a window insert with flange for easy insertion and removal of the window insert. Referring to FIG. 14, the window insert 10 is enclosed within a frame 11. To the framed insert, flange 12 closes the frame opening and provides a means to handle the flanged window insert.

Figure 15:
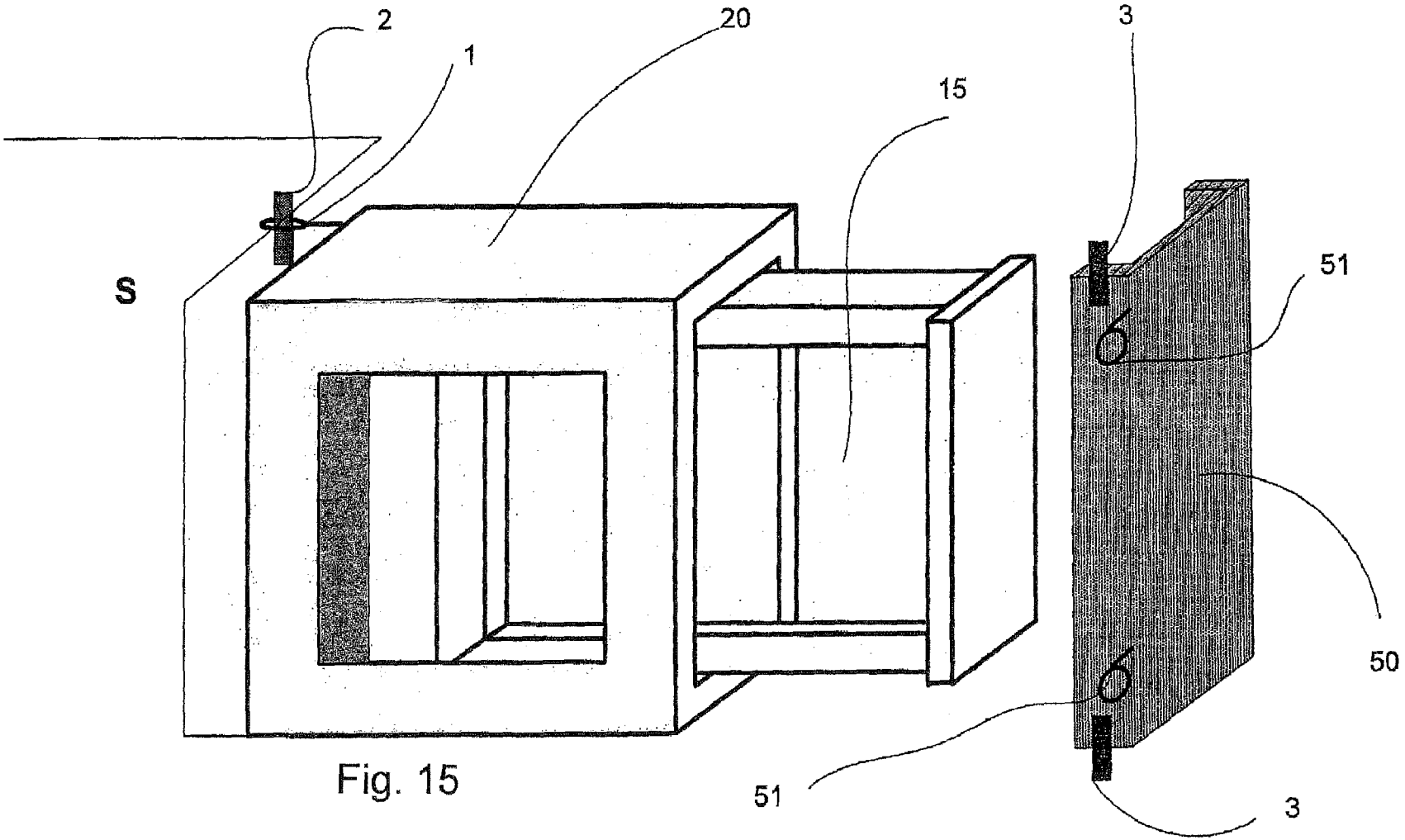
FIG. 15 is an isometric view of the pocket shutter module as it relates to the framed plastic insert and installation components for a single pocket shutter module, according to an embodiment of the present invention.

Referring to FIG. 15, window insert 10, frame 11 and flange 12 are assembled to form flanged insert 15. Installing the hurricane pocket shutter system first entails installing wall studs 2 into adjacent wall or box frame structure S surrounding the window or door opening.

Pocket shutter module 20 is a 6-sided skeletal housing with one open end. There are two wall studs 2 mounted to structure S to facilitate means of supporting pocket shutter module 20 about structure S.

Support means is accomplished by lifting, aligning and setting pocket shutter module 20 hinge rings 1 over wall studs 2. Not only is the pocket shutter module 20 supported, the pocket shutter module 20 is also hinged such that the pocket shutter module 20 can swing open in order to insert flanged insert 15 into the pocket shutter module 20.

Figure 16:
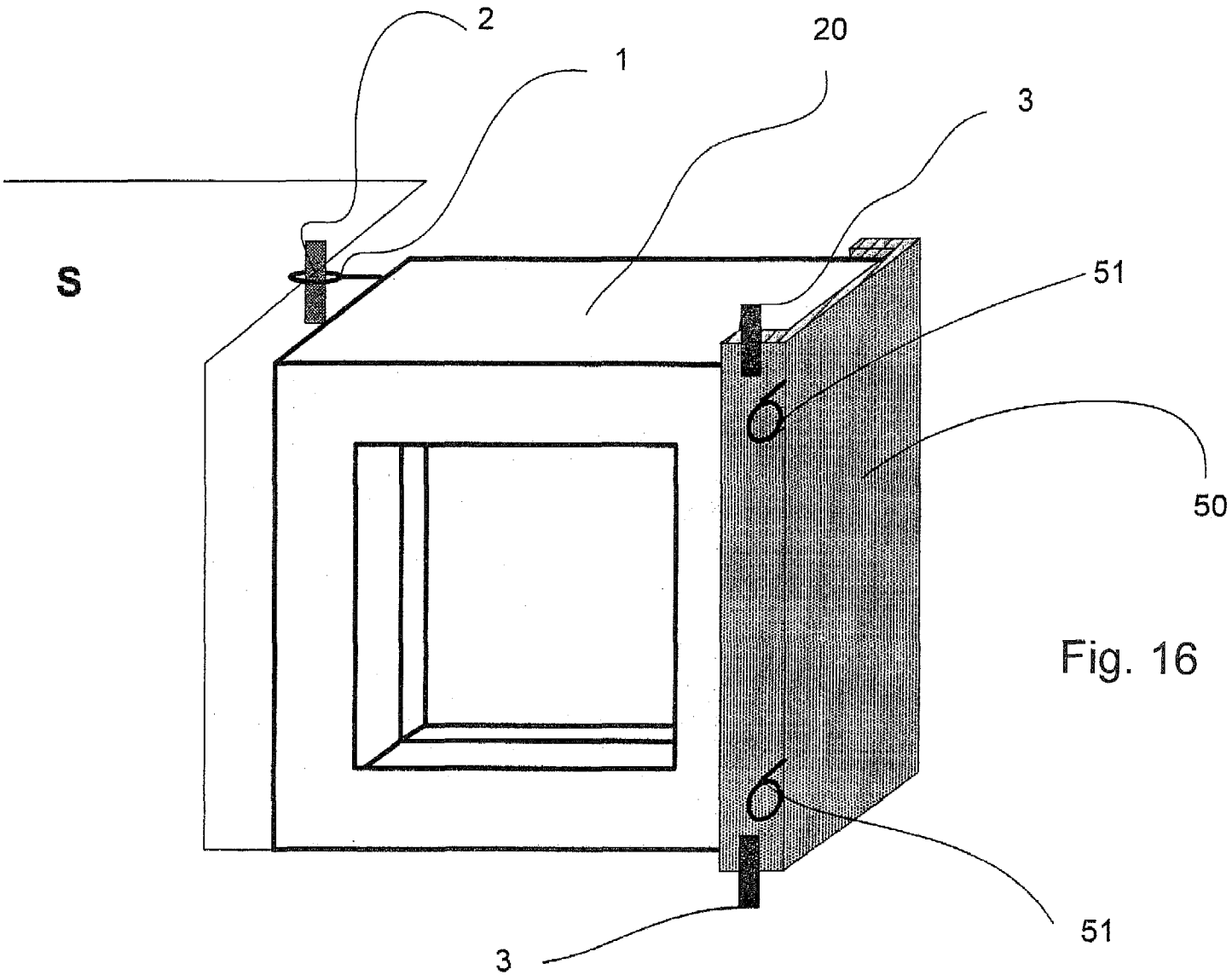
FIG. 16 is an isometric view of the pocket shutter module as it relates to framed plastic insert and mid section support channel in a closed position, according to an embodiment of the present invention.

After the pocket shutter module 20 is secured about structure S, with flanged insert 15 inserted within the pocket shutter module 20, section support channel 50 is used to close or secure flanged insert 15 within the pocket shutter module 20. To further secure pocket shutter module about structure S, deadbolt 3 mechanically attached to section support channel 50 is slid up and down, respectively, to secure pocket shutter module 20 against the top and bottom, respectively, of structure S. FIG. 16 shows a completely assembled single pocket shutter module 20 including pocket shutter module 20, flanged insert 15 and section support channel 50.

Figures 17, 18:
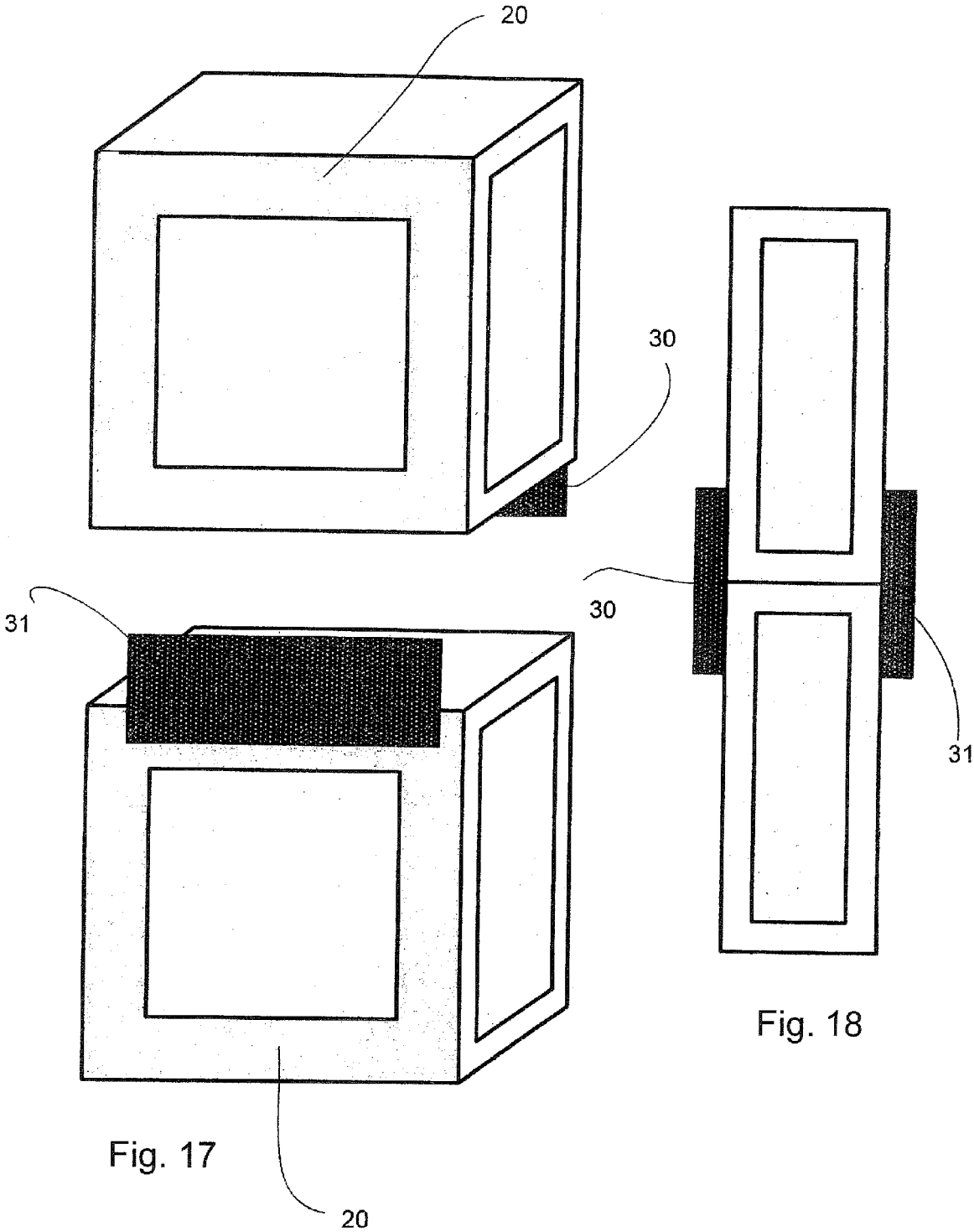
FIG. 17 an isometric view of two pocket shutter modules as it relates to module adjacent inside supports between upper and lower pocket shutter modules, according to an embodiment of the present invention.
FIG. 18 is a plan view of a set of two pocket shutter modules as it relates to module adjacent inside and outside supports between upper and lower pocket shutter modules, according to an embodiment of the present invention.
Figure 19:
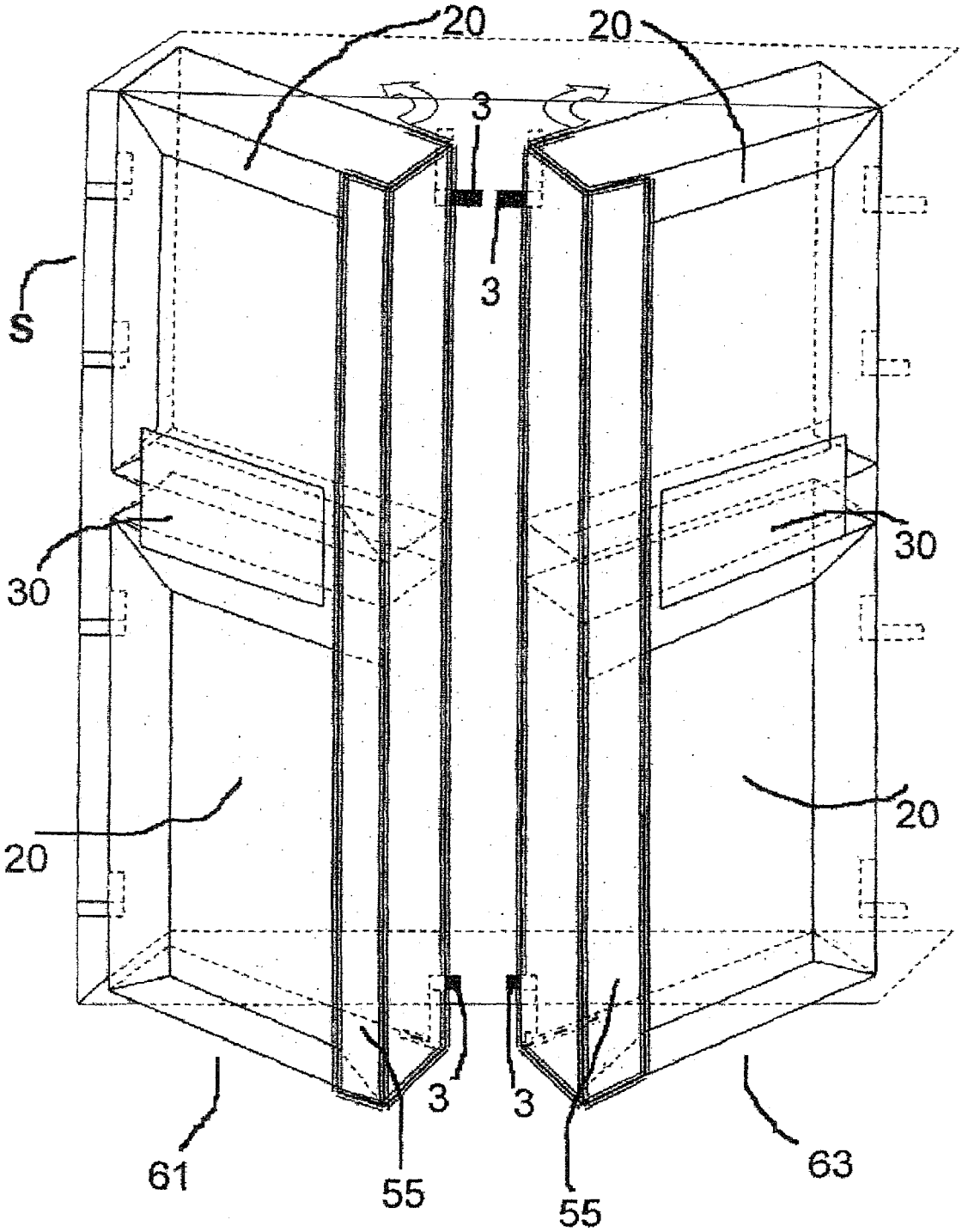
FIG. 19 is an isometric view of two pocket shutter modules as it relates to mid section support channels used for four or more pocket shutter module installations where pocket shutter modules open in an arc-like manner for insertion as preparation for a hurricane or storm, according to an embodiment of the present invention.

For varying window and door configurations and sizes, multiple pocket shutter modules are used. FIG. 17 refers to outer mid section support 30 and inner mid section support 31. FIG. 18 refers to an assembled view of two pocket shutter modules 20. Both outer and inner mid section supports 30 and 31, respectively, are recessed from the edges of pocket shutter module 20 to permit closure by section support channel 50. FIG. 19 shows an assembled view of two pocket shutter modules hinged on the left 61, and two pocket shutter modules hinged on the right 63 of structure S. Also shown is an extended section support channel 55 closing left pair of pocket shutter modules 61 and right pair of pocket shutter modules 63, respectively.

Figure 20:
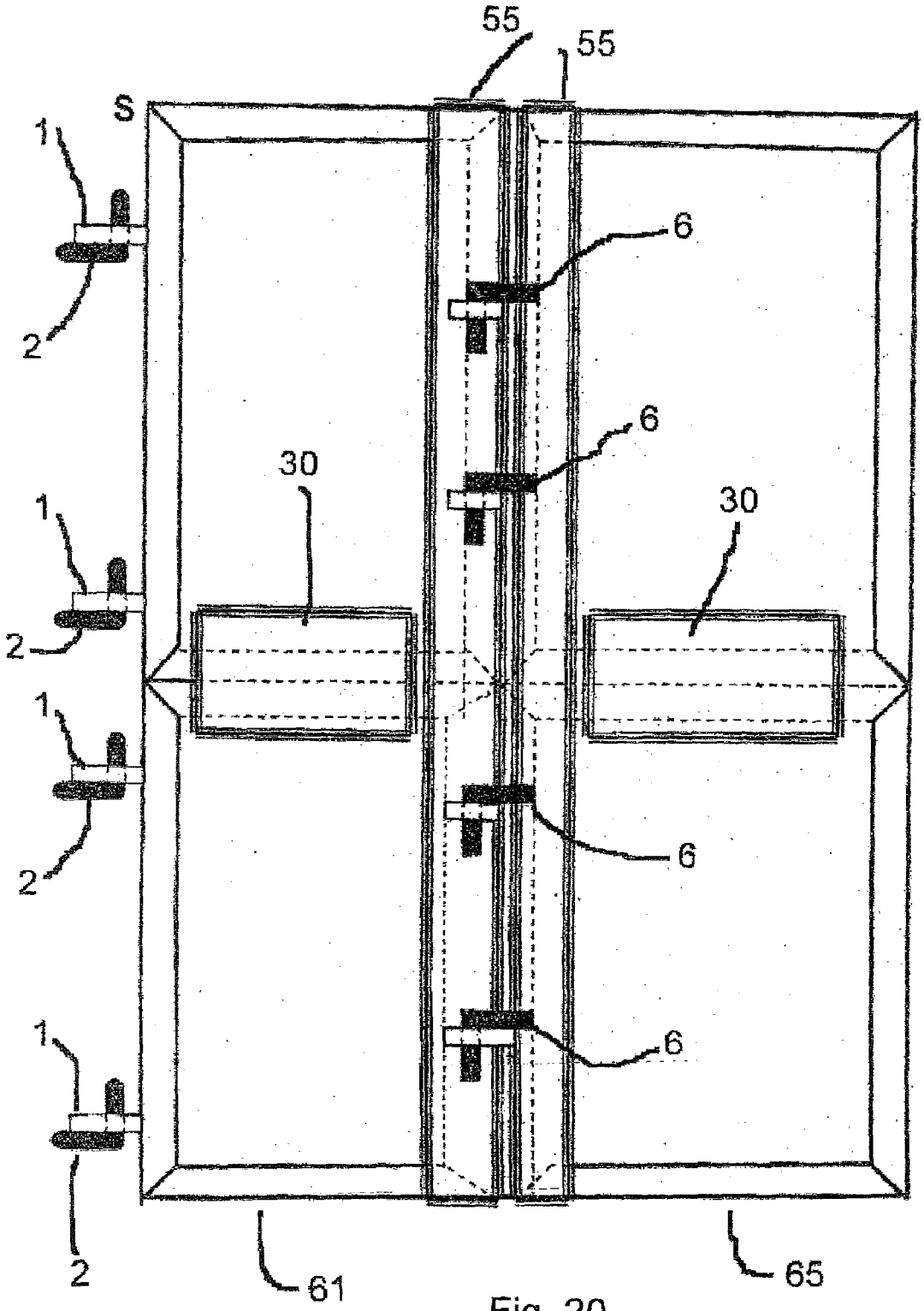
FIG. 20 is an isometric view of four pocket shutter modules such that two modules rotate about building hinge and two modules rotate about first two modules in a fold-like manner for insertion as preparation for a hurricane or storm, according to an embodiment of the present invention.

FIG. 19 illustrates two pairs of pocket shutter modules as they are hinged in an arc-like fashion to open for insertion or removal of flanged inserts. FIG. 20 illustrates outer view of two pairs of pocket shutter modules where the first pair of pocket shutter modules 61 is hinged about the structure S, and the second pair of pocket shutter modules 65 is hinged about the first pair of pocket shutter modules 61. In this figure, pocket shutter modules 65 includes rotational stud 6 that is inserted into expansion ring 62. In order to insert flanged inserts 15 into each pocket shutter 20, the first pair of pocket shutter modules 61 is swung outward, and as pocket shutter modules 61 move outward, pocket shutter modules 65 rotates about pocket shutter modules 61 such that both openings face the same outward direction permitting flanged inserts 15 to easily be inserted into respective pocket shutter modules 20.

With larger window and door openings, multiple pairs of pocket shutter modules can be added as shown in FIG. 19 as arc-type or FIG. 20 as folded or any combination thereof. Additionally a pair of pocket shutter modules may be replaced by more than a pair as the application warrants.

With the preferred embodiment, a home or business owner can either install the pocket shutter module wall stud 2 or pocket shutter module 20 with or without flanged insert 15 prior to the beginning of the hurricane season, and either add pocket shutter module 20 if only the studs were installed; or add flanged inserts 15 if both studs and pocket shutter module were installed just prior to the arrival of a hurricane. Another feature of the preferred embodiment is that once flanged inserts are installed, then deadbolts 3 are engaged from the inside of the home or business dwelling. The advantage is that in an emergency, the hurricane pocket shutter system can easily be opened from the inside providing the dweller an opportunity to escape. And since the system locks from the inside, the hurricane pocket shutter system also provides security.

For storm readiness, the home or business owner simply removes the latch stud 3 from top and bottom latching holes, and swivels pocket shutter module 20 about the hinge mechanism in an outward direction or away from the window or door frame to the open position. When in the open position, the home or business owner slides flanged insert 15 along the grooved insert of pocket shutter module 20 until flanged insert 15 is completely inserted into pocket shutter module 20.

In the preferred embodiment, window insert 10 can be any material such as a polycarbonate transparent material like LEXAN. Flanged insert 15 with LEXAN or similar material can be left inserted inside of pocket shutter module 20 throughout the hurricane season or easily removed between hurricanes. LEXAN is transparent and provides light passivity during or between hurricanes.

Figure 21:
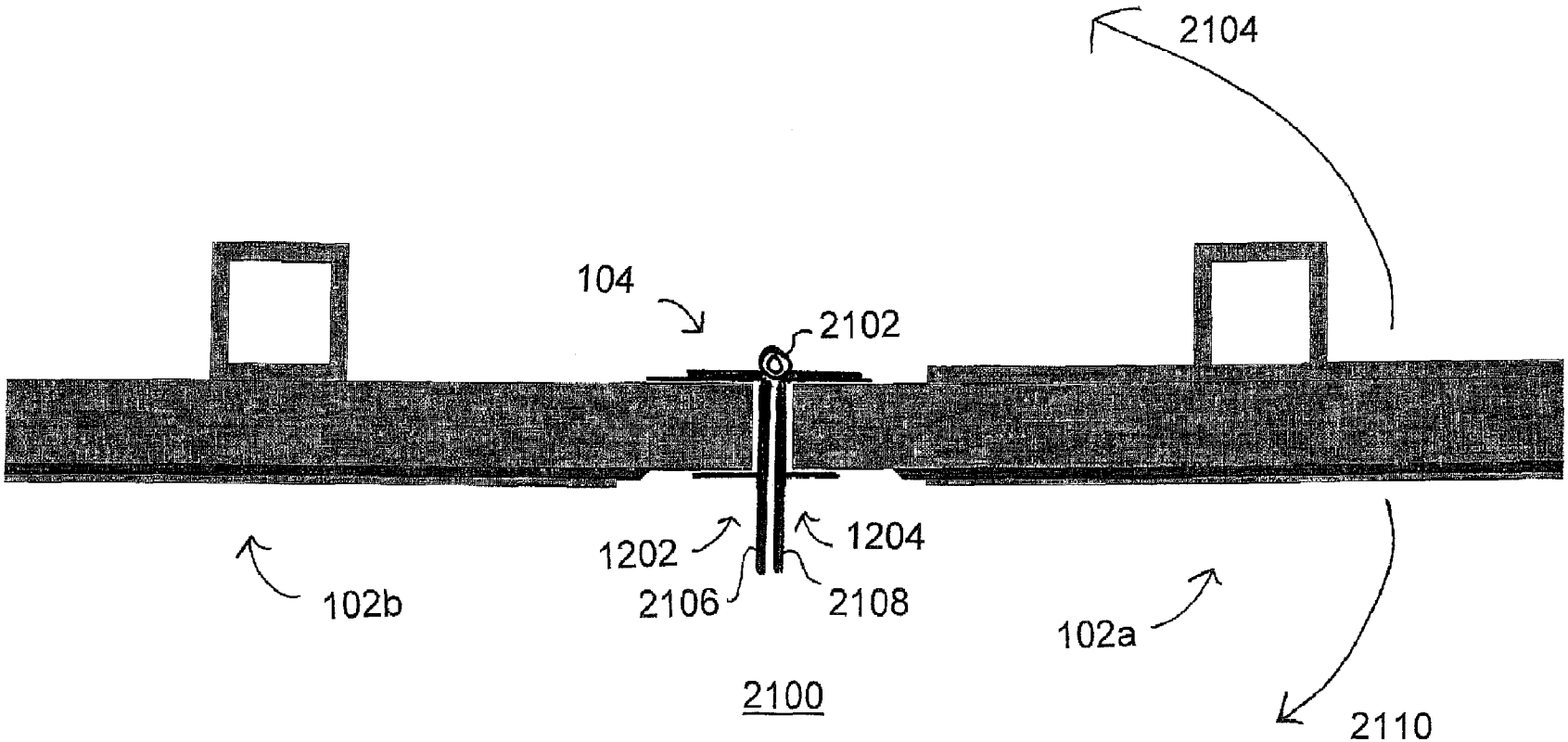
FIG. 21 is a fragmentary, enlarged plan view of a shutter assembly that includes an F-channel alignment track with a hinge, according to an embodiment of the present invention.

A further embodiment of the present invention is shown in FIG. 21. In this embodiment, the first shutter panel 102*a* and the second shutter panel 102*b* are coupled to the each other by the F-channel 104, which has a first track 1204 and a second track 1202 that are pivotally attached to each other by a hinge 2102. The hinge 2102 allows the first shutter panel 102*a* to move relative to the second shutter panel 102*b* in a first direction 2104. Hinge 2102 can be a single hinge or multiple hinges. The legs 2106 and 2108 of the F-channel 104 prevent movement of first shutter panel 102*a* relative to the second shutter panel 102*b* in a second direction 2110 opposite the first direction 2104. The hinge 2102 allows the panels to be folded on top of each other. This folding ability has several advantages, which includes the ability to aesthetically store the shutters assembly 2100, which includes at least two panels 102 in a configuration that appears from a distance to be only one panel on the outside of the building.

Figure 22:
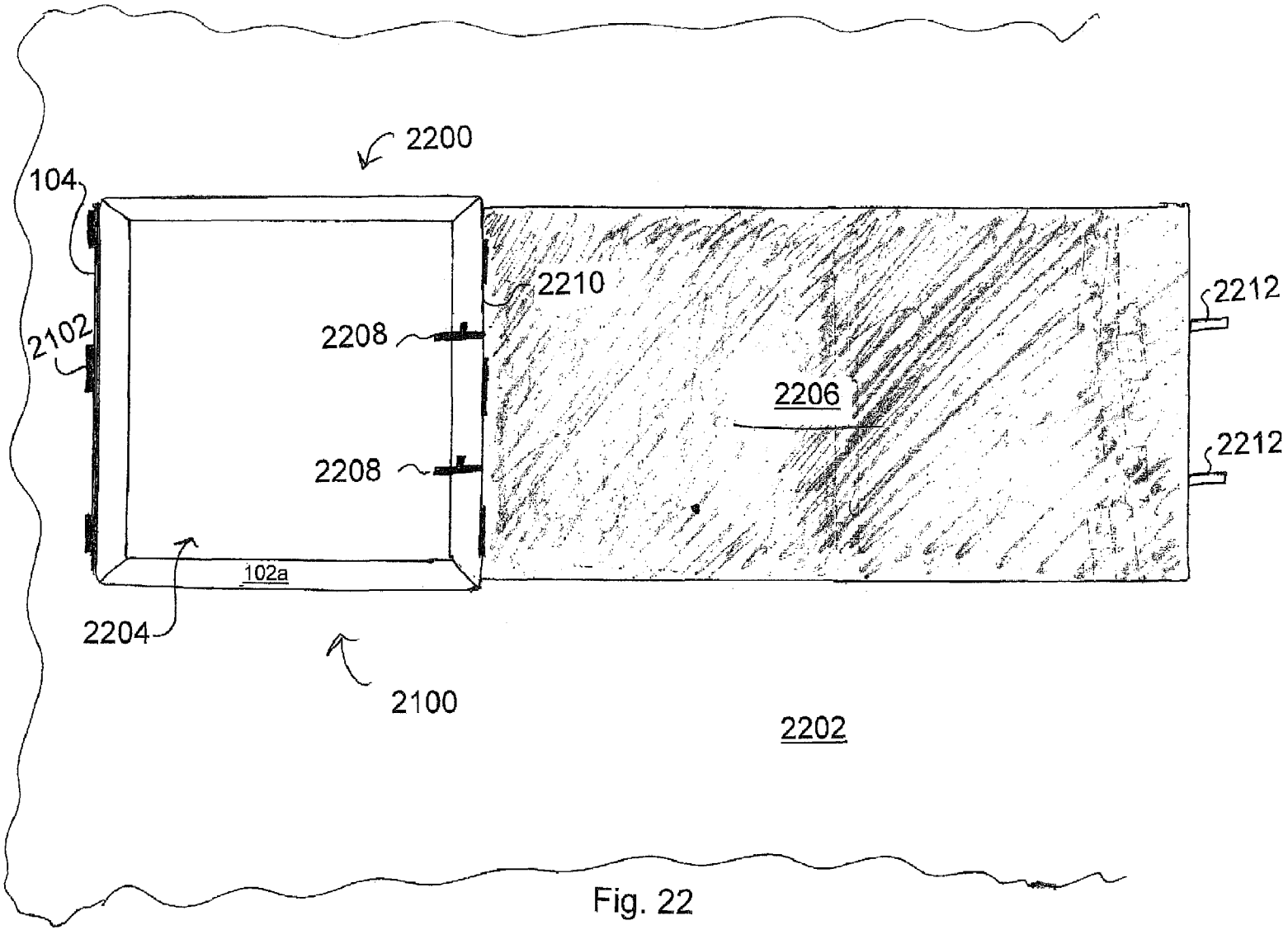
FIG. 22 is an elevational view of the shutter assembly shown in FIG. 21 folded into a stowed position, according to an embodiment of the present invention.

FIG. 22 shows an elevational view of the assembly 2100 in its stowed position 2200 attached to a building structure 2202. In the stowed position 2202, only panel 102*a* is visible to one viewing the building 2202 from this elevational perspective. The hinge 2102 of the F-channel 104 allows the first shutter panel 102*a* to remain in the same configuration (i.e., exterior face 2204 facing away from the building 2202) as when the shutter assembly 2100 was deployed and protecting the building's opening 2206. Accordingly, the F-channel 104 can still be seen on the left side of the shutter panel 102*a*. Behind shutter panel 102*a* is shutter panel 102*b*, which cannot be seen in this view, with its exterior side facing the building 2202. The assembly 2100 can be stored with or without membrane panels in place.

In this embodiment, one or more securing mechanisms 2208 are attached to, or couple to, an edge 2210 of the first shutter panel 102*a*. The securing mechanism 2208 shown in FIG. 22 are sliding pins, however, the invention is not so limited and can include other securing mechanisms, such as screws, bolts, hooks, and many others. A coupling half 2212 of the securing mechanism is attached to or near an edge 2214 of the aperture 2206 of the building structure 2202. The securing mechanism 2208 can slide into and couple with the coupling half 2212 of the mechanism once the shutter assembly 2100 is deployed and covering the opening 2206. Although two panels 102*a* and 102*b* are all that are shown and described in connection with this folding embodiment, more than two panels can be included in the assembly 2100.

Figure 23:
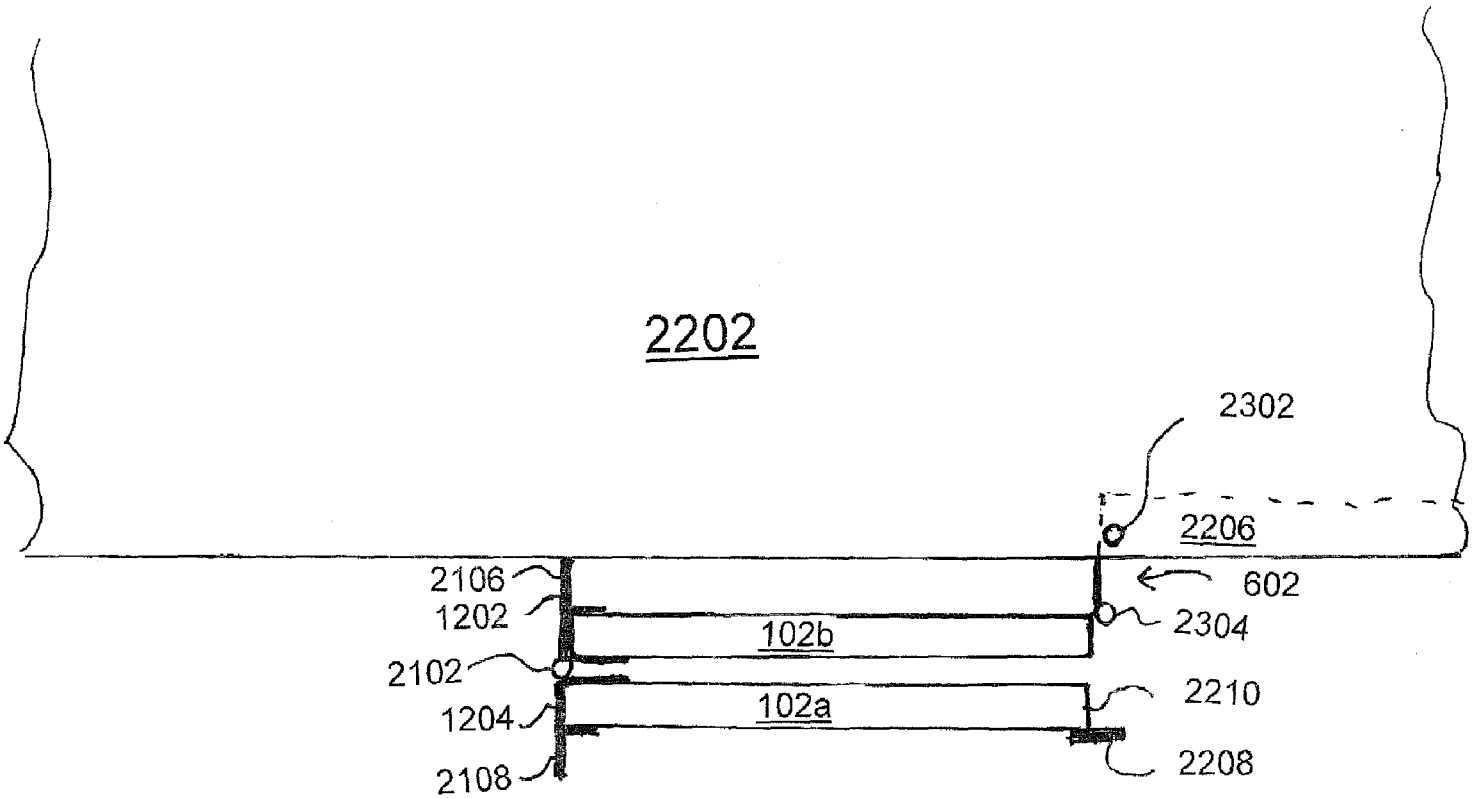
FIG. 23 is a plan view of the folded shutter assembly of FIG. 22, according to an embodiment of the present invention.

Moving now to FIG. 23, a top view of the panel assembly 2100 and partially hidden view of the building 2202 is shown. In this view, both shutter panels 102*a* and 102*b* can be seen folded and placed next to the building 2202. Leg 2106 of F-track 1202 makes contact with the building 2202 and spaces the shutter 102*b* away from the building. In order to maintain a consistent distance from the building 2202 all along the length of the shutter 102*b*, in one embodiment, the position of the hinge assembly 602 is spaced away from the building 2202 by a distance approximately equal to the length of the leg 2106 of the F-channel track 2102.

FIG. 23 shows a first position 2302 where the pivot point of the hinge 602 could have been located for a non-folding shutter assembly, such as that shown in FIG. 6, inter alia. This pivot point 2302 could be moved to the extended position 2304 by a "T" shaped adapter, or any other extending device.

Figure 24:
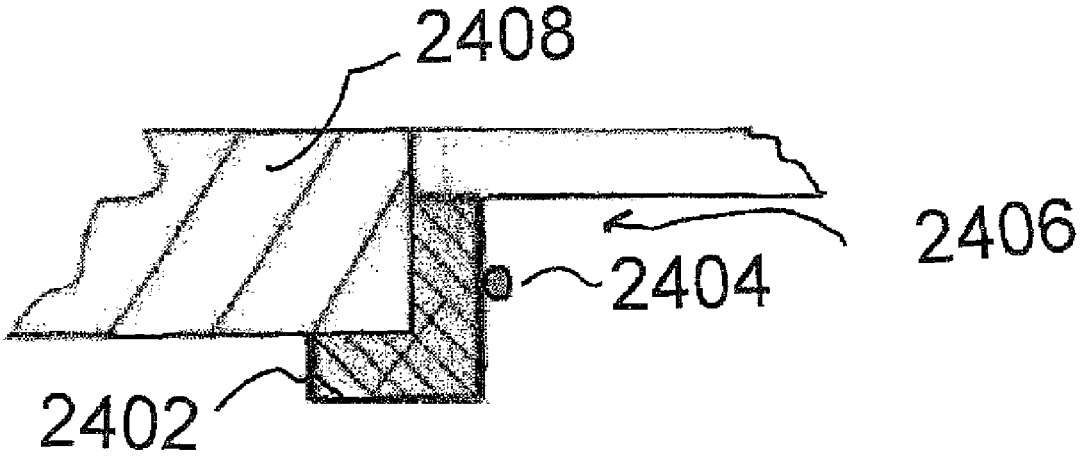
FIG. 24 is a cross-sectional view of one exemplary embodiment of a shutter panel hinge attachment using angle material.
Figure 25:
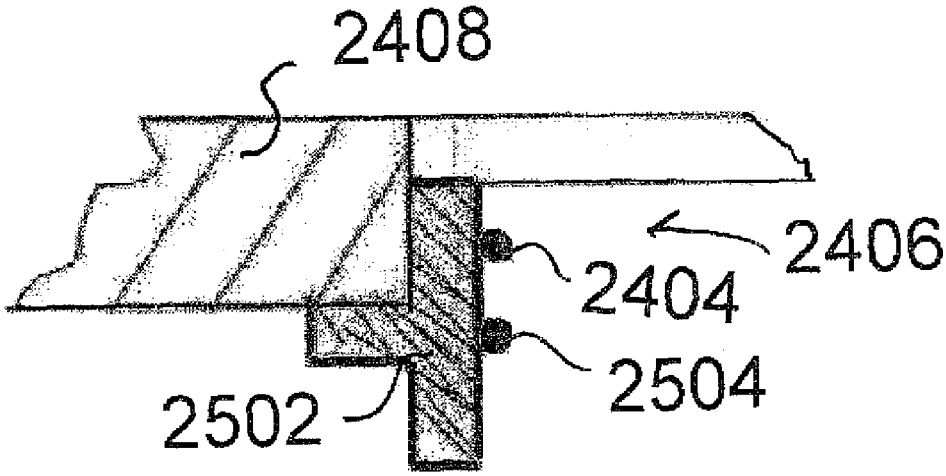
FIG. 25 is a cross-sectional view of one exemplary embodiment of a shutter panel hinge attachment using a "T" adapter.

FIG. 24 shows an angle 2402 that is used for attaching female hinge portions 2404 to a recess 2406 of a door or window 2408. For the foldable embodiment 2100 of the present invention, a "T" adapter 2502, as shown in FIG. 25 may be used. The "T" shape provides sufficient coupling space to the recess 2406 and to the new hinge location 2504. An alternative to the T-adapter is a length of tubing that extends past the recess 2406.

The folding directions, hinge locations, hinge types, and stowing and deployment configurations shown in FIGS. 21-25 are merely exemplary and are not meant to limit the invention in any way. The present invention can have many other options for folding one or more shutter panels relative to one or more other shutter panels.

CONCLUSION

As should now be clear, embodiments of the present invention provide a shutter assembly that protects apertures, such as glass covered openings and doors, of a building during a hurricane or other violent natural elements. The assembly includes a hinged pocket system where pockets are filled with opaque, transparent, or translucent rigid materials that form an missile-repellant outer sheath protecting the building apertures. The hinge system makes it easy to open and re-close the individual shutter panels between subsequent hurricanes without compromising building security or ability of emergency escape. The shutters, whether individually, or as an assembly are lightweight and fast and easy to install.

NON-LIMITING EXAMPLES

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. A shutter assembly comprising:

a first and second shutter panel, each comprising:

a missile-repelling membrane panel;

a frame having an elongated hollow body with inwardly disposed wall elements forming an inwardly facing U-shaped channel adapted to retain the membrane panel on at least two sides; and a membrane-retaining element separably attachable to the frame, allowing the membrane panel to be removed from the frame or secured within the frame;

a first hinge assembly with a first side attached to the frame of the first shutter panel and a second side attached to a building structure;

a second hinge assembly with a first side attached to the frame of the second shutter panel and a second side attached to the building structure; and an alignment track with a first F-shaped portion that couples to the membrane-retaining element of the first shutter panel and a second F-shaped portion that couples to the membrane-retaining element of the second shutter panel, the first and second F-shaped portions of the alignment track making respective contact with each other and preventing the first and second shutter panels from moving relative to each other in at least one direction.

2. The shutter according to claim 1, wherein the missile-repelling membrane panel comprises:

a frame surrounding a missile-repelling membrane material.

3. The shutter according to claim 2, wherein the missile-repelling membrane material comprises at least one of LEXAN and KEVLAR.

4. The shutter according to claim 1, wherein the membrane panel has a strength sufficient to withstand an impact of a 2×4 at 200 miles per hour without allowing the 2×4 to penetrate through the membrane panel.

5. The shutter assembly according to claim 1, further comprising:

a first stop attached to a lower portion of the frame of the first shutter panel; and a second stop attached to an upper portion of the frame of the second shutter panel, wherein the first stop and the second stop, when the lower portion of the frame of the first shutter is placed directly above the upper portion of the frame of the second shutter and a pivot of the first hinge is coaxially aligned with a pivot of the second hinge, allow the first and second shutters to be moved relative to each other in a first pivot direction and prevent the first and second shutters from moving relative to each other in a second pivot direction.

6. The shutter assembly according to claim 1, further comprising:

a first stop attached to a lower portion of the frame of the first shutter panel; and a second stop attached to an upper portion of the frame of the second shutter panel, wherein the first stop and the second stop, when the lower portion of the frame of the first shutter is placed directly above the upper portion of the frame of the second shutter and when a pivot of the first hinge is coaxially aligned with a pivot of the second hinge, allow the first shutter to be moved relative to the second shutter in a first pivot direction and prevent the first shutter from moving relative to the second in a second pivot direction.

7. The shutter assembly according to claim 1, wherein:

the first alignment track and the second alignment track are pivotally coupled to each other.

8. The shutter assembly according to claim 1, further comprising:

a locking mechanism accessible from an interior of a building structure and substantially preventing the shutter assembly from movement relative to the building structure when installed.

9. The shutter according to claim 1, wherein the frame comprises:

a first, a second, and a third frame element, each element capable of receiving and retaining a separate side of the membrane panel.

10. The shutter according to claim 1, wherein each membrane-retaining element comprises:

an elongated hollow body with inwardly disposed wall elements forming an inwardly facing U-shaped channel adapted to retain the membrane panel on one side thereof.

11. The shutter according to claim 10, further comprising:

a set of ribs disposed within the hollow body of the frame; and a set of ribs disposed inside the hollow body of the membrane-retaining element.

12. The shutter according the claim 11, further comprising:

an L-shaped bracket adapted to fit between the ribs in the frame and the ribs in the membrane retaining element and physically couple the frame and the membrane-retaining element.

* * * * *